US012459072B2

(12) United States Patent
Schneider et al.

(10) Patent No.: US 12,459,072 B2
(45) Date of Patent: Nov. 4, 2025

(54) APPARATUS AND METHOD FOR LENS PROCESSING AND PROCESSING DEVICE AND MEASURING DEVICE FOR LENSES

(71) Applicant: SCHNEIDER GmbH & Co. KG, Fronhausen (DE)

(72) Inventors: Gunter Schneider, Marburg (DE); Klaus Hofmann, Wehrheim (DE); Klaus Krämer, Dautphetal-Friedensdorf (DE); Sebastian Schneider, Marburg (DE)

(73) Assignee: SCHNEIDER GmbH & Co. KG, Fronhausen (DE)

( * ) Notice: Subject to any disclaimer, the term of this patent is extended or adjusted under 35 U.S.C. 154(b) by 734 days.

(21) Appl. No.: 17/269,924

(22) PCT Filed: Sep. 4, 2019

(86) PCT No.: PCT/EP2019/073599

§ 371 (c)(1),
(2) Date: Feb. 19, 2021

(87) PCT Pub. No.: WO2020/049052

PCT Pub. Date: Mar. 12, 2020

(65) Prior Publication Data

US 2021/0316414 A1 Oct. 14, 2021

(30) Foreign Application Priority Data

Sep. 4, 2018 (DE) ..... 10 2018 006 980.0
Sep. 21, 2018 (DE) ..... 10 2018 007 463.4

(51) Int. Cl.
*B24B 13/005* (2006.01)

(52) U.S. Cl.
CPC ..... *B24B 13/0055* (2013.01)

(58) Field of Classification Search
None
See application file for complete search history.

(56) References Cited

U.S. PATENT DOCUMENTS 2,493,206 A 1/1950 Okey
5,372,241 A 12/1994 Matsumoto
(Continued)

FOREIGN PATENT DOCUMENTS

CN 103237625 A 8/2013
CN 203509833 U 4/2014
(Continued)

OTHER PUBLICATIONS

International Preliminary Report on Patentability for International Application No. PCT/EP2019/073599, mailed Mar. 18, 2021.
(Continued)

*Primary Examiner* — Brian D Keller
*Assistant Examiner* — Jason Khalil Hawkins
(74) *Attorney, Agent, or Firm* — Jason H. Vick; Amped IP LLC

(57) ABSTRACT

The present invention relates to an apparatus for lens processing, with at least one receiving device for at least one transport box, with at least one measuring device, and at least one processing device. According to the invention it is provided that between the at least one measuring device and the at least one processing device at least one conveying device is provided, that between the at least one receiving device, the at least one measuring device and the at least one conveying device at least one handling device or apparatus is provided in such a way that the at least one measuring device, the at least one conveying device and the at least one processing device can be arranged or are arranged in any number and/or orientation relative to each other. The present
(Continued)

Figure 1:
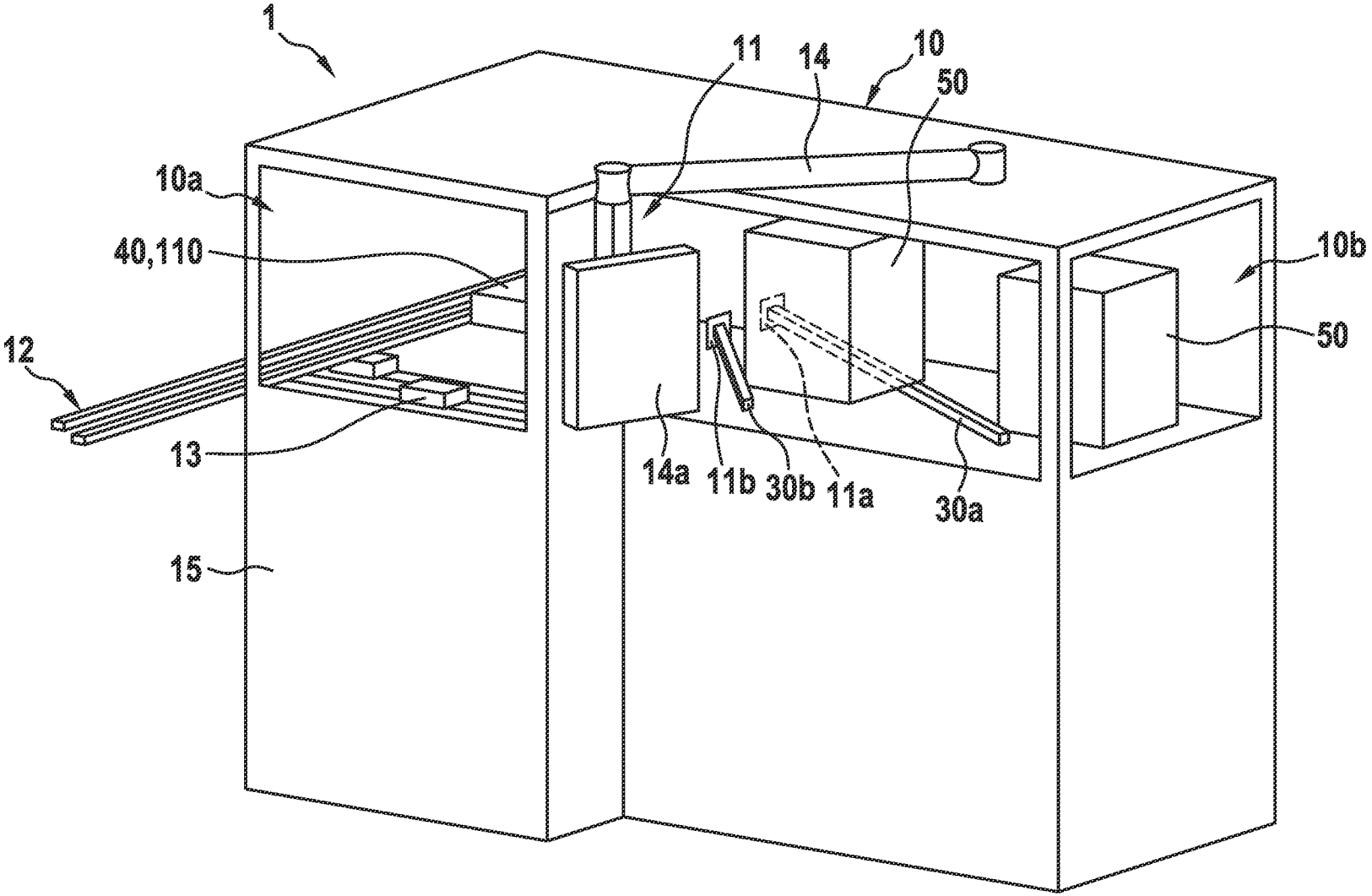

invention further relates to a corresponding method for lens processing and to a processing device for lenses.

19 Claims, 16 Drawing Sheets

(56) References Cited

U.S. PATENT DOCUMENTS

| | | | | |
|---|---|---|---|---|
| 5,454,194 | A | 10/1995 | Gottschald | |
| 6,427,094 | B1 * | 7/2002 | Mizuno | B24B 9/144 451/42 |
| 6,896,587 | B2 * | 5/2005 | Guillermin | B24B 9/148 451/8 |
| 6,902,468 | B2 | 6/2005 | Luderich et al. | |
| 7,909,559 | B2 | 3/2011 | Lukas et al. | |
| 8,616,150 | B2 | 12/2013 | Savoie et al. | |
| 8,944,315 | B2 | 2/2015 | Schneider | |
| 8,976,250 | B2 | 3/2015 | Armstrong-Muntner et al. | |
| 2007/0264915 | A1 | 11/2007 | Mazoyer | |
| 2014/0228995 | A1 * | 8/2014 | Tanaka | B24B 27/0023 700/112 |
| 2015/0053530 | A1 | 2/2015 | Schneider | |
| 2015/0298283 | A1 * | 10/2015 | Maruyama | B24B 49/12 156/345.13 |
| 2017/0348823 | A1 * | 12/2017 | Gerrath | B24B 9/148 |
| 2018/0318978 | A1 | 11/2018 | Schneider et al. | |
| 2019/0389026 | A1 | 12/2019 | Huttenhuis et al. | |

FOREIGN PATENT DOCUMENTS

| | | | |
|---|---|---|---|
| CN | 204758502 | U | 11/2015 |
| DE | 4107084 | A1 | 9/1991 |
| DE | 4127094 | A1 | 2/1993 |
| DE | 102005057725 | A1 | 6/2007 |
| DE | 102008023093 | A1 | 11/2009 |
| EP | 2489468 | A2 | 8/2012 |
| EP | 2636484 | A2 | 9/2013 |
| JP | 2000-218487 | A | 8/2000 |
| KR | 2008-0057920 | A | 6/2008 |
| WO | WO 01/70460 | | 9/2001 |
| WO | WO 2013/131656 | | 9/2013 |
| WO | WO 2016/095939 | | 6/2016 |
| WO | WO 2017/080639 | | 5/2017 |
| WO | WO 2018/153787 | A1 | 8/2018 |

OTHER PUBLICATIONS

Invitation to Pay Additional Fees and, Where Applicable Protest Fee for International Application No. PCT/EP2019/073599, mailed Dec. 18, 2019.

International Search Report for International Application No. PCT/EP2019/073599, mailed Mar. 13, 2020.

Written Opinion for International Application No. PCT/EP2019/073599, mailed Mar. 13, 2020.

* cited by examiner

APPARATUS AND METHOD FOR LENS PROCESSING AND PROCESSING DEVICE AND MEASURING DEVICE FOR LENSES

CROSS-REFERENCE TO RELATED APPLICATIONS

This application is a national stage application under 35 U.S.C. 371 of PCT Application No. PCT/EP2019/073599 having an international filing date of 4 Sep. 2019, which designated the United States, which PCT application claimed the benefit of German Application No. 10 2018 006 980.0, filed 4 Sep. 2018 and German Application No. 10 2018 007 463.4, filed 21 Sep. 2018, each of which are incorporated herein by reference in their entirety.

An exemplary aspect relates to a device for lens processing, in particular spectacle lens processing, a processing device for lenses, in particular spectacle lenses, a measuring device for measuring lenses, and a method for lens processing, in particular for spectacle lens processing, in particular according to the claims as appended hereto.

A generic device and a generic method are known from DE 41 27 094 A1. This document discloses a processing station for edge processing of lenses with a handling apparatus in the form of a gripper arm, three edge processing devices and at least two sensors for measuring and/or aligning the lenses to be processed. The handling device takes a lens to be processed from a storage container and conveys this lens first to a device for aligning the lens and then to an edge processing device. This process is repeated until all edge processing devices are loaded. When edge processing is complete, the finished lens is removed from the edge processing device and placed back in the magazine. The disadvantage here is the comparatively long processing time of the lenses from their measurement to the completion of the edge processing.

WO 2001/070460 A1 discloses an apparatus and a method for measuring and edge processing lenses, wherein the lenses to be processed are distributed to two processing units, each consisting of a measuring device and an edge processing device.

US 2007/0264915 A1 describes a device for edge processing of ophthalmic lenses, in which a measuring device coupled to a loading table and an edge processing device for an ophthalmic lens are linked by means of a loading arm.

The object of the present invention is to provide an apparatus, a processing device, a measuring device and/or a method, each of which permits flexibly manageable measurement and/or alignment and/or processing, in particular edge processing, of lenses with the shortest possible processing time or the highest possible throughput of lenses, starting from the removal of the lenses from a transport box up to and including the deposition of the finished processed lenses in a transport box.

The exemplary solution includes an apparatus, a processing device, a measuring device, and/or a method with the features of the claims as appended hereto. Advantageous further developments are the subject of the subclaims.

According to a first aspect of the present invention, it is preferably provided that at least one conveying device is provided between the at least one measuring device and the at least one processing device, that at least one handling device or apparatus is provided between the at least one receiving device, the at least one measuring device and the at least one conveying device, in particular in such a way that the at least one measuring device, the at least one conveying device and the at least one processing device are arranged or can be arranged in any number and/or orientation relative to one another.

The device according to the invention thus preferably has a modular design.

At least one measuring device and at least one processing device are operatively connected to each other via at least one conveying device.

The arrangement of measuring device(s), processing device(s) and conveying device(s) in relation to each other can be varied according to the invention. Thus, according to the invention, any number of measuring devices can be linked with any number of processing devices. For example, a single measuring device can be linked to two or more processing devices, or two or more measuring devices can be linked to a single processing device, or in particular two or more measuring devices can be linked to two or more processing devices.

Furthermore, measuring device(s), conveying device(s) and/or processing device(s) are freely selectable with regard to their technical and/or structural design and/or with regard to their mode of operation. As a result, the device according to the invention can be adapted to a wide variety of requirements for the measurement and/or processing of lenses (e.g. with regard to measurement duration and/or processing duration and/or size and/or shape).

As a result, flexible measurement and processing of the lenses is achieved with the shortest possible processing time and/or the least possible time loss, starting from the measurement of the lenses to the completion of the processing.

A further aspect according to the invention is that with the device according to the invention, a particularly high throughput of finished processed, in particular edge-processed lenses (e.g. number of finished processed lenses per hour) can be achieved. In principle, this can be achieved either by means of the selected number of measuring device(s) and/or processing device(s) or on the basis of the selected technical design and/or mode of operation or on the basis of the selected throughput of the measuring device(s) and/or processing device(s) as such or by means of a combination of two or more of these measures.

The modular structure of the device according to the invention thus relates in particular to the number of measuring devices and/or processing devices present, to the way in which they are linked and/or to the choice of the structural design and/or the mode of operation of the measuring devices and/or processing devices.

According to another aspect which can also be realized independently, the present invention relates to a device for lens processing. The apparatus comprises two measuring devices, two processing devices, two conveying devices and a handling device. The handling device is provided between the measuring devices and the conveying devices and comprises a handling unit for transferring lenses from the measuring devices to the conveying devices, so that there is no fixed assignment of a measuring device exactly to a processing device.

According to a further aspect which can also be realized independently, the present invention relates to an apparatus for lens processing, in particular edge processing of lenses. The apparatus comprises a first and a second measuring device for measuring lenses to be processed and a first and a second processing device for processing, in particular edge processing, the lenses. Furthermore, the device has a housing which surrounds the measuring devices and processing devices or forms a common housing for the measuring devices and the processing devices. The device is designed in such a way that, after a measurement in one of the measuring devices, the lenses can be conveyed as desired to the first or the second processing device or to a conveying device assigned to the respective processing device. This enables a flexible workflow and a high throughput of lenses.

The device preferably has a handling device which is designed to remove lenses from both measuring devices and optionally transfer them to one of the processing devices or to a conveying device assigned to the respective processing device for conveying the lenses to the respective processing device. This is conducive to a high throughput.

Another aspect of the present invention, which can also be realized independently, relates to a processing device for edge processing of lenses having a rough processing area and a fine processing area. In the processing device, two one-piece spindle housings are provided which are arranged offset from each other on a rotating device in such a way that they are rotatable by 180° about an axis of rotation, so that each one-piece spindle housing is arranged to be transferable from the rough processing area to the fine processing area and back. This is conducive to high throughput.

A further aspect of the present invention, which can also be realized independently, relates to a processing device for processing, in particular edge processing, lenses. The processing device has a rough processing area and a fine processing area and is designed for simultaneous processing of lenses in the rough processing area and fine processing area. Further, the processing device has a spindle device with two workpiece spindles, wherein the workpiece spindles are each designed to hold a lens during processing. The spindle device with the workpiece spindles is rotatable so that the workpiece spindles can be moved from the rough processing area to the fine processing area and vice versa. This is conducive to high throughput.

The workpiece spindles are preferably arranged at a fixed distance from each other, in particular so that when the spindle device is rotated by 180°, the workpiece spindles exchange their positions.

The spindle device is preferably rotatable about a preferably vertical axis of rotation and/or by means of a rotating device, in particular by 180°, for changing the workpiece spindles between the rough processing area and the fine processing area.

Preferably, the rough processing area has exactly one tool spindle and/or the fine processing area has several, in particular five, tool spindles.

The method according to the invention is characterized by the fact that the lenses to be processed are removed from the transport containers in any order, that the lenses are fed to any measuring device and/or that the lenses are fed to any processing device.

In particular, the lenses to be processed can be transported in any order to a freely selectable measuring device and then by means of a freely selectable conveying device to a processing device and back again. This allows a particularly flexible measurement and edge processing of the lenses, since always that measuring device and/or conveying device and/or processing device can be selected, which is available for a measurement and/or edge processing of the respective lens.

A further aspect of the present invention, which can also be realized independently, relates to a method for processing, in particular edge processing, of lenses in a processing device having a rough processing area and a fine processing area. The processing device has a spindle device with two workpiece spindles, preferably arranged at a fixed distance from one another. One workpiece spindle holds a lens during processing in the fine processing area, while at the same time the other workpiece spindle holds a second lens in the rough processing area. After processing in the fine processing area, the spindle device is rotated, in particular by 180°, so that the workpiece spindle located in the fine processing area is pivoted into the rough processing area and the lens located in the rough processing area is pivoted into the fine processing area. This is conducive to high throughput.

Preferably, while a lens is being machined in the fine processing area, a lens is loaded into the workpiece spindle located in the rough processing area, unloaded from the workpiece spindle located in the rough processing area, and/or machined in the rough processing area. This is conducive to high throughput.

It is further preferred that, in particular during processing of a lens in the fine processing area, a conveying device removes a finished machined lens from the workpiece spindle in the rough processing area and then transfers a lens to be machined to this workpiece spindle. This is conducive to high throughput.

It is preferred that the conveying device takes over a finished processed lens from the workpiece spindle by means of a second gripper or suction cup, wherein the second gripper or suction cup is then swiveled away and a lens to be processed is handed over to the workpiece spindle by means of a first gripper or suction cup while retaining its orientation.

The device according to the invention or the method according to the invention is/are particularly advantageous if a lens with an above-average processing time enters the apparatus according to the invention, for example because its measurement and/or its processing is above-average due to special circumstances (such as, for example, extraordinary optical properties with respect to the measurement, numerous and/or complex processing steps, for example due to a complex desired edge shape). With the device according to the invention or the method according to the invention, it is possible, for example, to feed such a lens to its measurement and processing at a time when the waiting time for the subsequent lenses to be processed can be minimized.

In other words: A lens to be processed with a shorter processing time can "overtake" another lens to be processed with a longer processing time, in particular by means of appropriate control of the at least one handling device or apparatus and/or the at least one conveying device. It can thus be avoided that such a lens determines the working speed of the entire device.

Thanks to the decoupling of measurement and processing and the possibility of freely selecting the sequence in which the lenses are fed to their measurement and processing, time-consuming measurement and/or processing of one lens can be performed without unduly delaying the measurement and/or processing of subsequent lenses.

The apparatus according to the invention and the method according to the invention are particularly suitable for edge processing of spectacle lenses.

An edge processing of a lens in the sense of the present invention is in particular a processing (exclusively) of the edge of the lens for adapting the lens to a spectacle frame. In particular, the edge processing (exclusively) changes the geometric shape of the edge or adapts it to a spectacle frame.

The processing device according to the invention preferably has a rough processing area and also a fine processing area. Particularly preferably, the rough processing area is arranged in a loading area of the processing device. The processing device according to the invention allows the edge processing of two lenses at the same time and/or in a time-overlapping manner, namely the rough processing of a first lens and the fine processing of a second lens. This results in considerable time savings in the edge processing of lenses.

Advantageous further embodiments result from the subclaims.

Advantageously, at least two processing devices and/or at least two measuring devices are provided. The greater the number of processing devices and measuring devices selected, the greater the number of lenses that can be processed per hour. In practice, a combination of two measuring devices and two to four processing devices has proven to be particularly suitable.

It is advisable to provide identically constructed measuring devices and/or identically constructed processing devices so that each lens can be measured and/or processed using the same procedures. Depending on the circumstances of the individual case, however, it may also be advantageous to provide measuring devices and/or processing devices of different designs for carrying out different measuring procedures or processing procedures.

The at least one measuring device can advantageously be designed for contactless measurement by means of deflectometry, transmission radiation and/or luminescence radiation. Thus, lenses with different optical properties can be measured as quickly as possible.

The at least one measuring device can of course also be equipped in a manner known per se, for example with probes for tactile measurement.

Particularly preferably, the handling device or apparatus has a first handling unit for transferring the lenses from at least one transport box to the at least one measuring device and/or from the at least one conveying device to the at least one transport box, and preferably a second handling unit for transferring the lenses from the at least one measuring device to the at least one conveying device. In this way, in particular the decoupling of the at least one measuring device from two or more processing devices, i.e. the free selection of the processing device after measurement of the lens to be processed, can be realized in a particularly simple manner.

Advantageously, the at least one holding device forms a buffer area for the lenses to be processed and/or their transport boxes. This measure enables the free selection of the processing sequence of the lenses to be processed in a particularly simple manner. In particular, the buffer device can have at least two, preferably at least three conveyor belts, which are expediently arranged to run parallel to one another. In the latter, the center belt serves to circulate transport boxes, which can each be directed from the outer conveyor belts onto the center belt and back onto the outer conveyor belts.

The device according to the invention expediently has at least one measuring area for the at least one measuring device and at least one processing area for the at least one processing device. Thus, measuring area(s) and processing area(s) can be spatially separated from each other in a simple manner.

The receiving area or receiving device can advantageously be provided in a measuring area to ensure easy transport of the lenses into the at least one measuring device then provided in spatial proximity.

Advantageously, the at least one conveying device extends over the at least one measuring area and the at least one processing area to bridge the spatial separation between the at least one measuring area and the at least one processing area.

The at least one measuring area and the at least one processing area can also be separated from each other by a partition wall. In this case, the at least one conveying device can advantageously pass through at least one opening provided in the partition wall.

The method according to the invention is preferably designed in such a way that the respective measuring device and/or the respective processing device can be selected depending on the measuring and/or processing effort of the respective lens to be processed and/or depending on free capacities at the measuring device and/or processing device. In particular, it can be selected whether one or more measuring devices or one or more processing devices are selected and/or whether identical or different measuring devices or identical and/or different processing devices are used for carrying out the method according to the invention. This enables fast and flexible measurement and processing of the lenses. Dead times at the at least one measuring device or at the at least one processing device can be minimized. Lenses with above-average measurement and/or processing times can be selected for measurement and processing in such a way that the waiting times for subsequent lenses with, for example, shorter measurement and/or processing times can be minimized or even completely avoided.

An advantageous further development of the method according to the invention is that at least two lenses can be measured and/or processed simultaneously. Particularly preferred is the simultaneous processing of at least four lenses, since the processing of the lenses usually takes longer than the measurement of the lenses.

The processing device according to the invention preferably has two workpiece spindles, in particular each arranged in a spindle housing, preferably wherein the two spindle housings are designed to be pivotable relative to one another, in particular in such a way that they can be pivoted alternately into the rough processing area and the fine processing area of the device according to the invention. The lens to be processed can thus be fed to different processing steps with different, freely selectable tools in a particularly simple manner.

If the two spindle housings are arranged offset to each other, the "flight circle", i.e. the radius to be kept free for the movement of the two housings, is reduced in an advantageous way.

Figure 2:
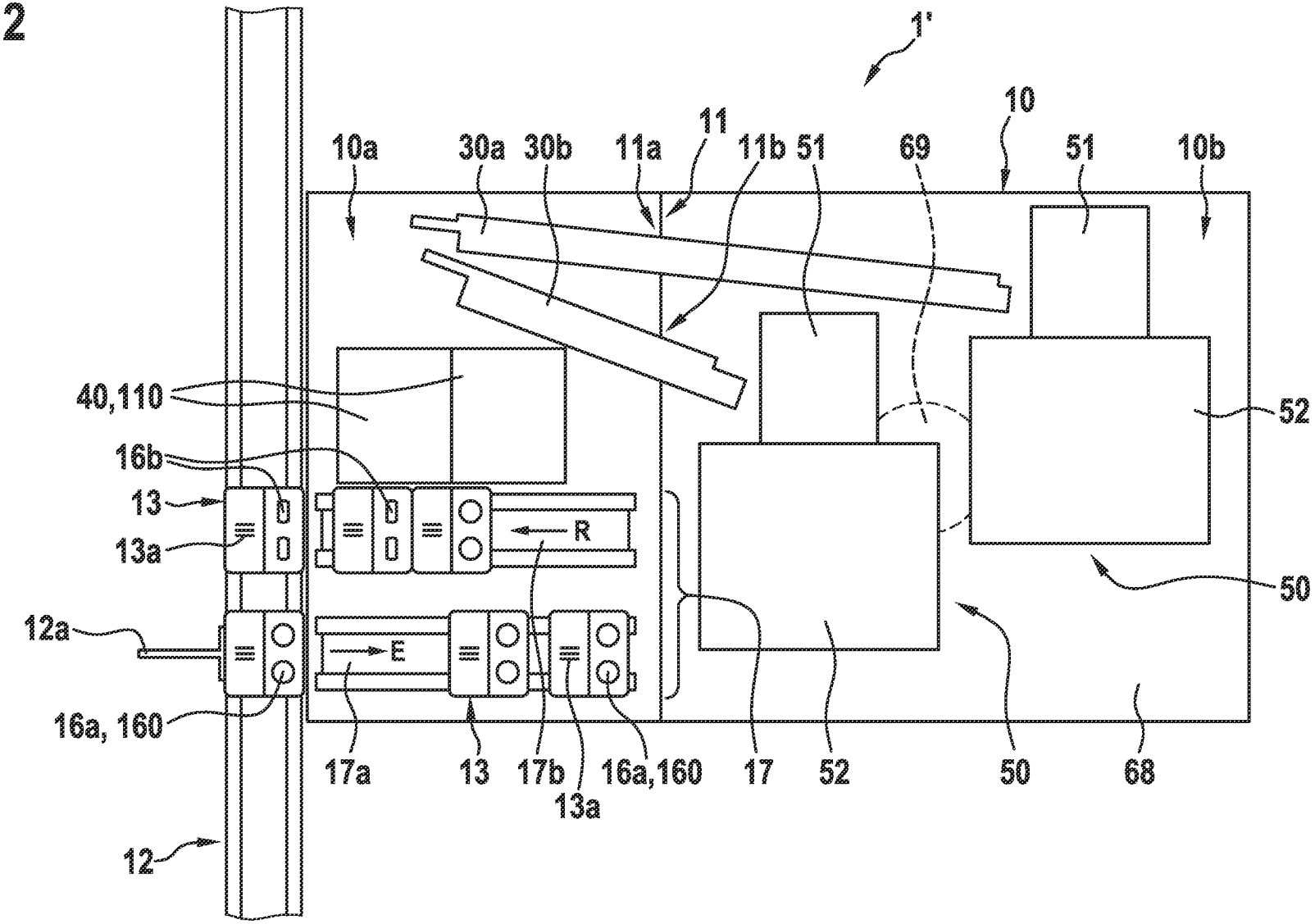
Figure 3:
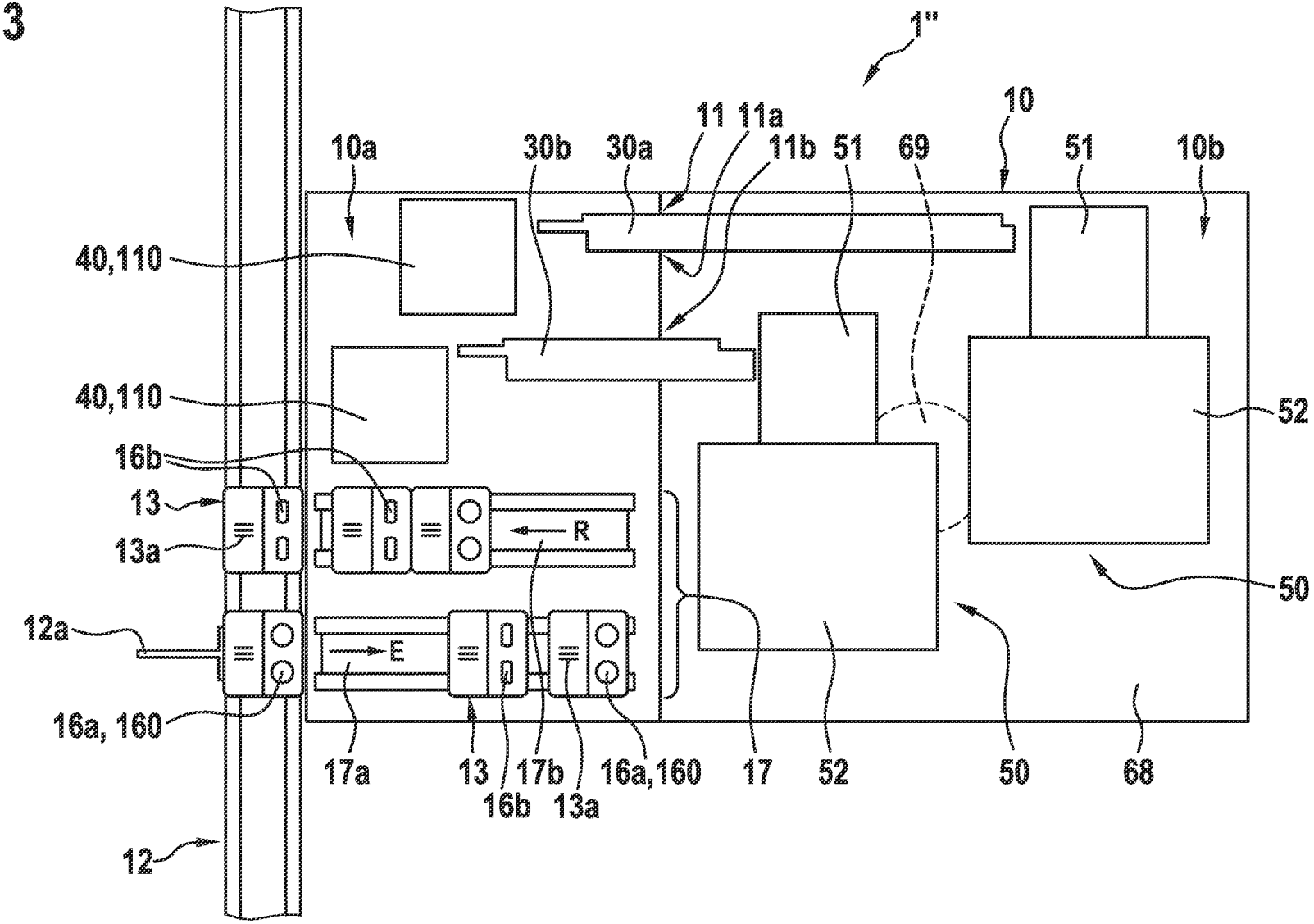
Figure 4:
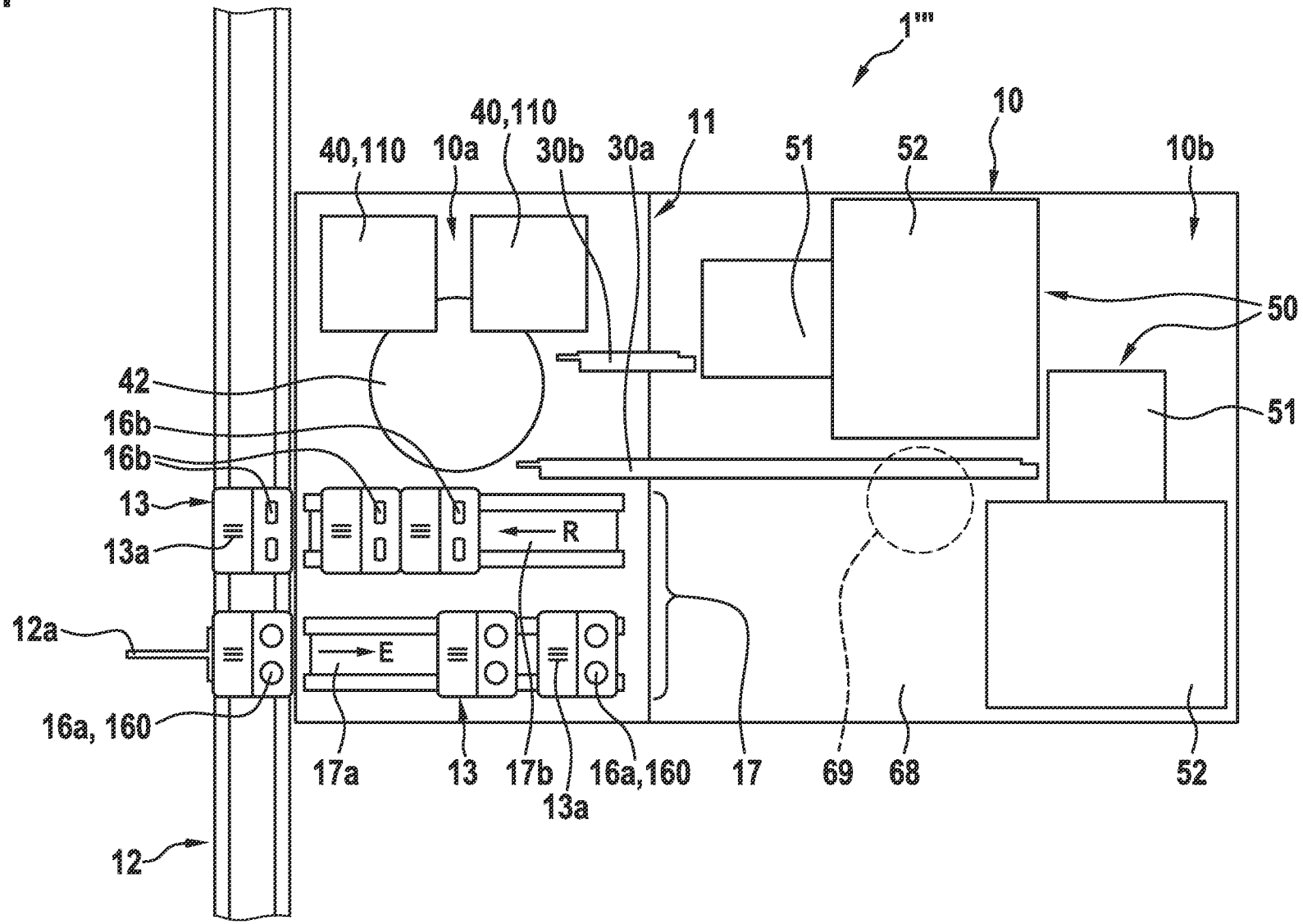
Figure 5:
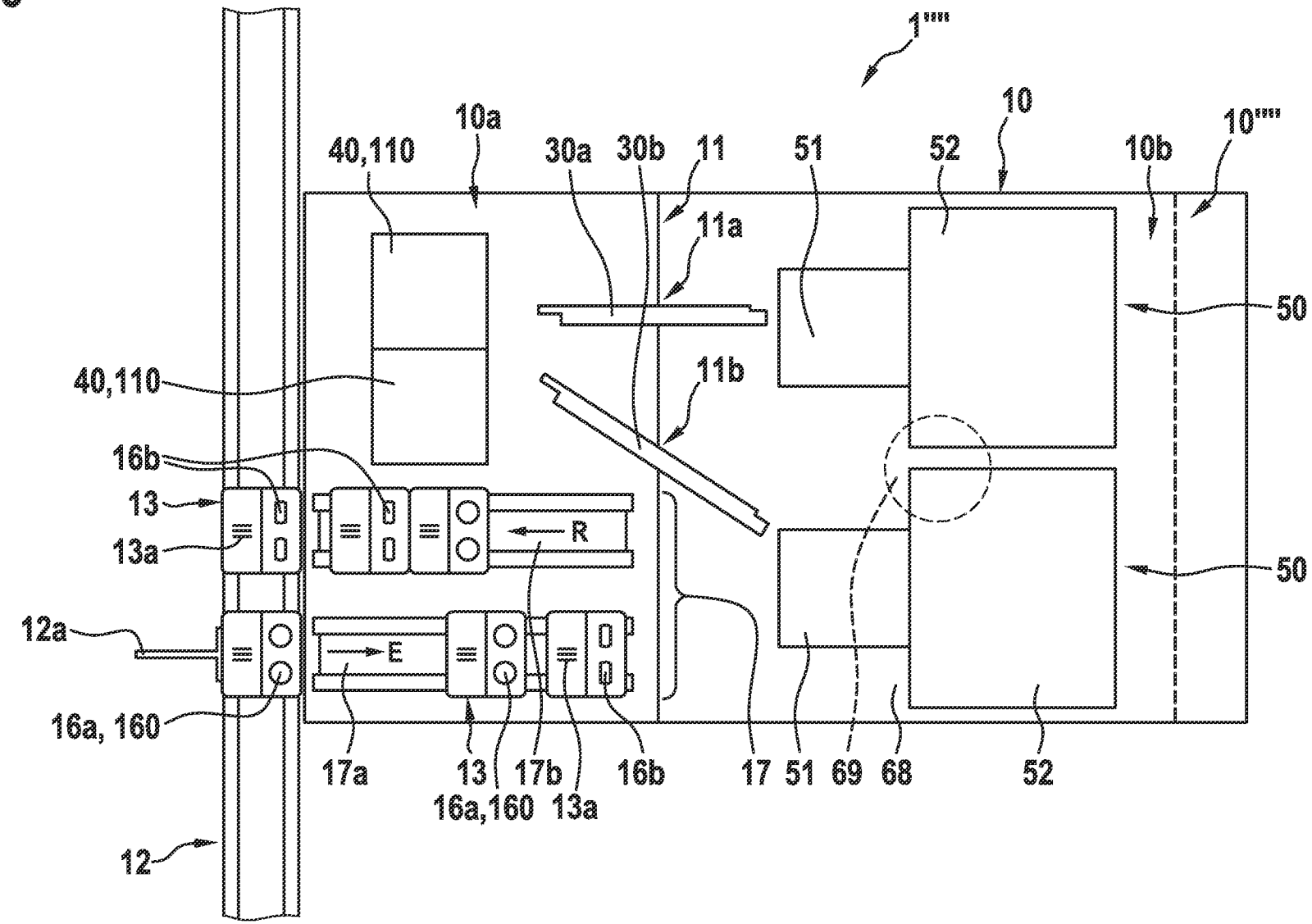
Figure 6A:
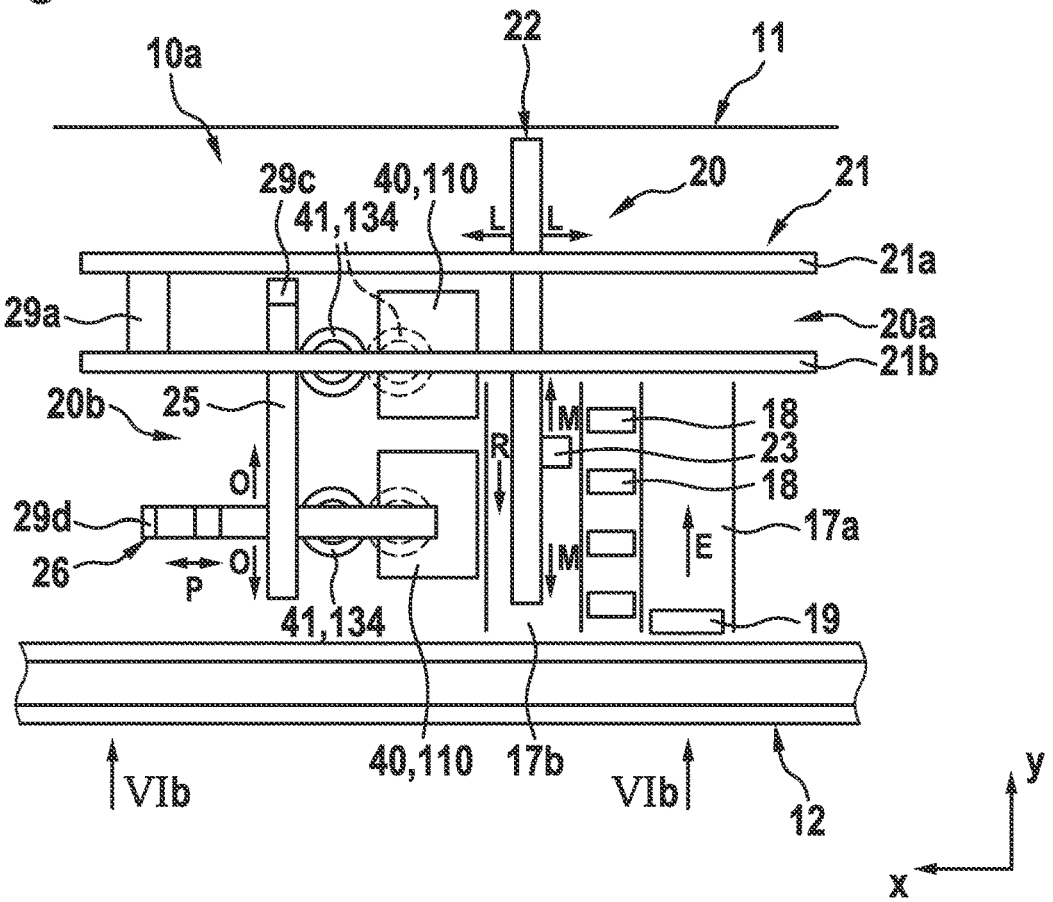
Figure 6B:
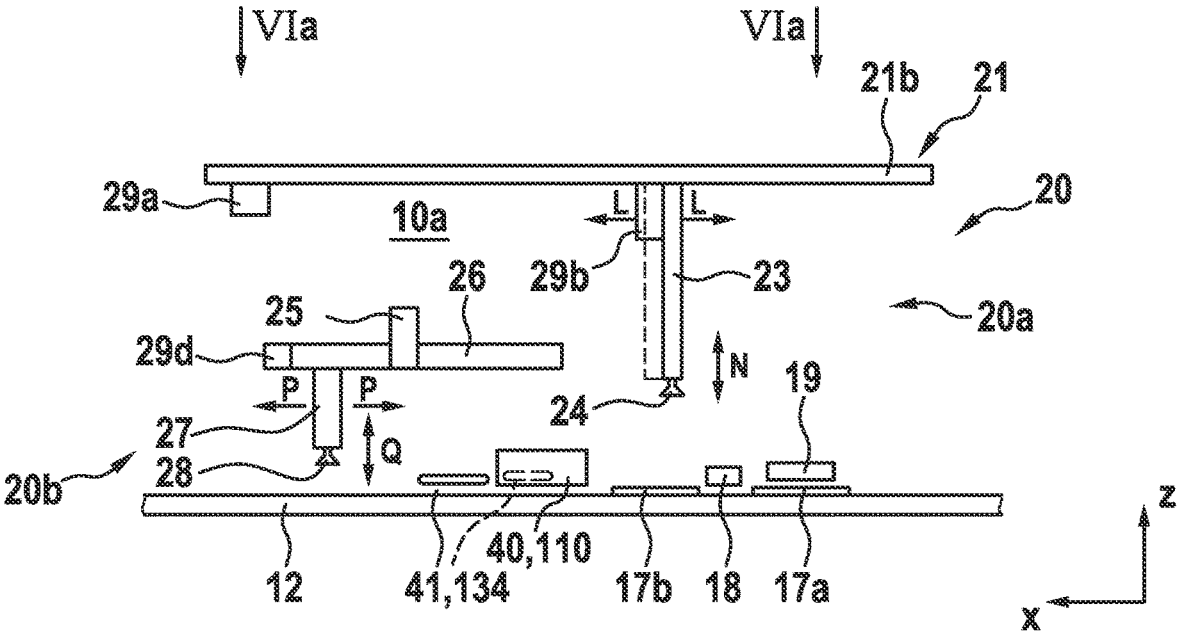

Examples of embodiments of the present invention are described in more detail below with reference to the accompanying drawings. In this connection, all the features and characteristics as described above or resulting below from the figure description and the claims can be realized independently of one another and in any desired combination. It shows in schematic, not to scale representation:

FIG. 1 a perspective view of a first embodiment of the basic structure of the apparatus according to the invention;

FIG. 2 a top view of a second embodiment of the apparatus according to the invention;

FIG. 3 top view of a third embodiment of the apparatus according to the invention;

FIG. 4 a top view of a fourth embodiment of the apparatus according to the invention;

FIG. 5 a top view of a fifth embodiment of the apparatus according to the invention;

FIG. 6*a* a plan view of an embodiment of a handling device or apparatus for the apparatus according to the invention;

FIG. 6*b* a side view of the handling device or apparatus according to FIG. 6*a;*

Figure 7:
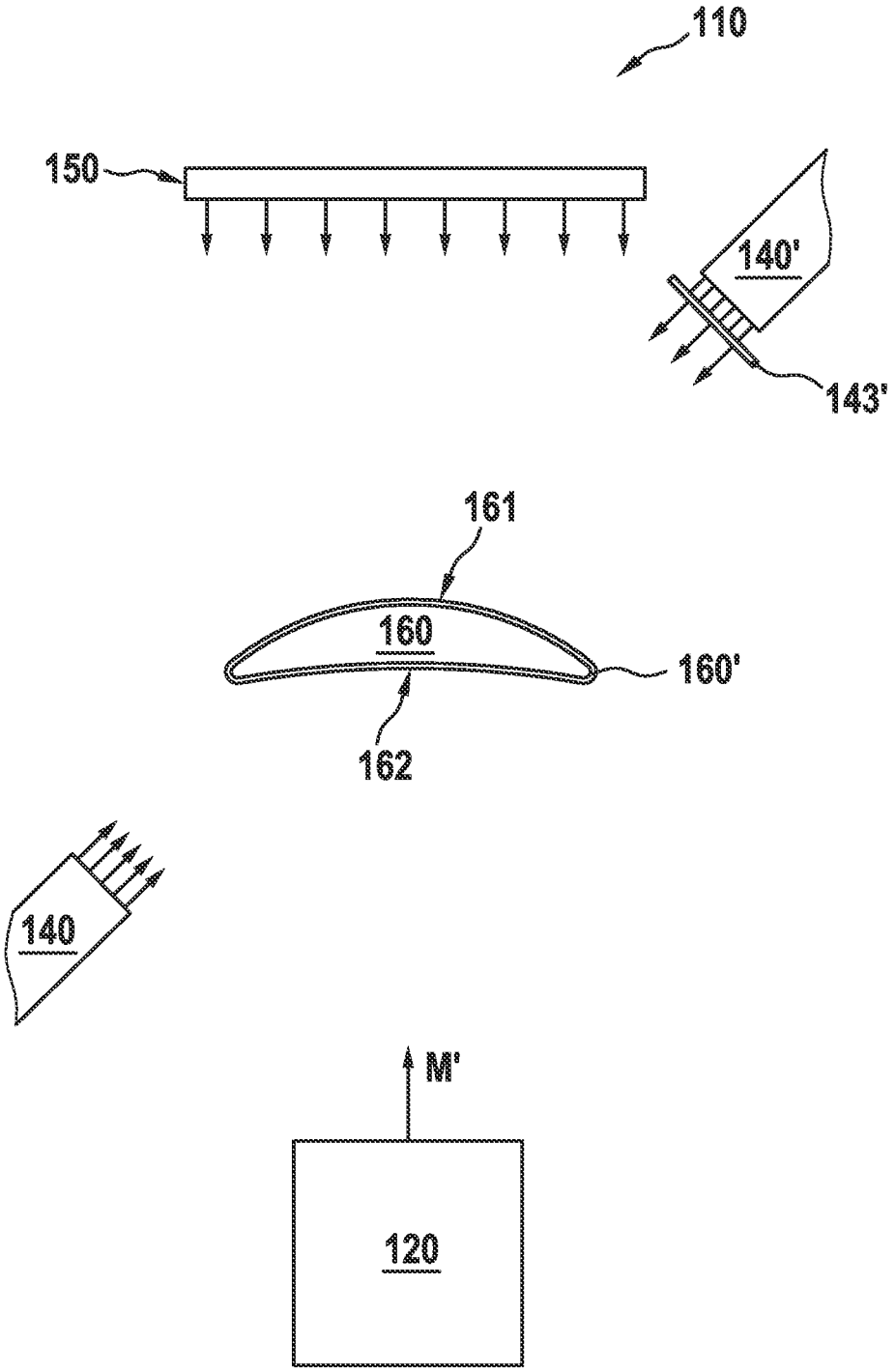
Figure 8:
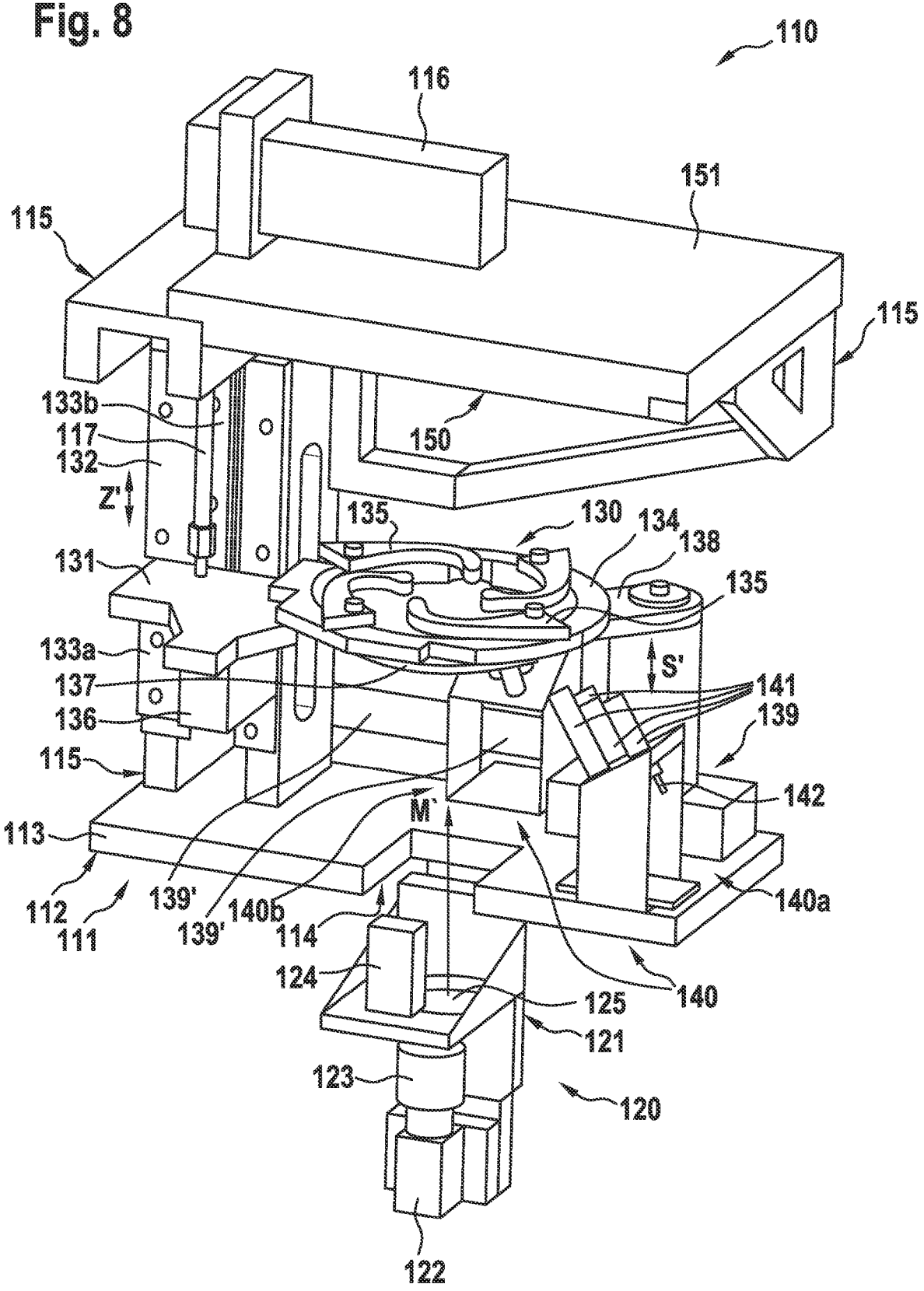
Figure 9:
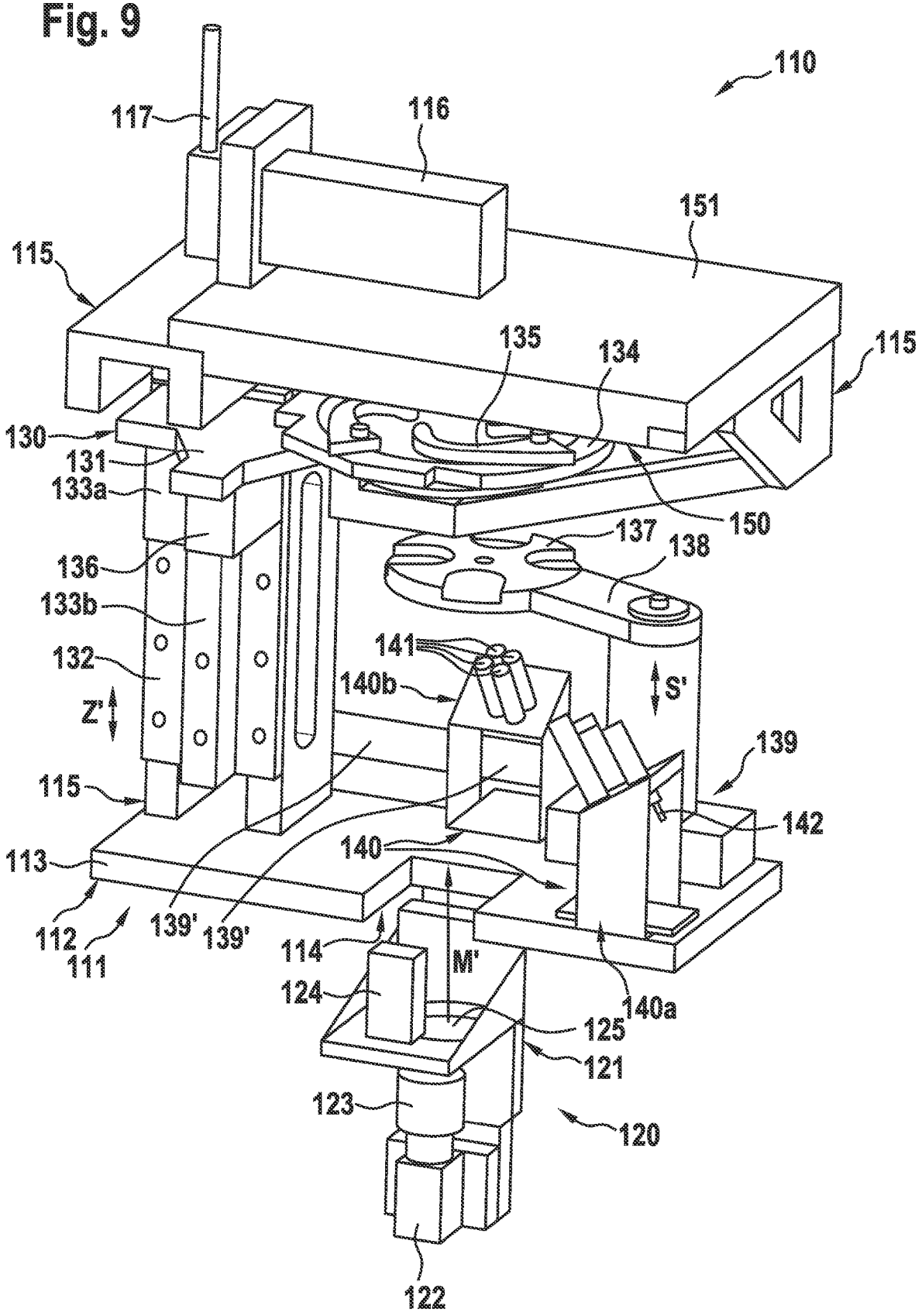
Figure 10:
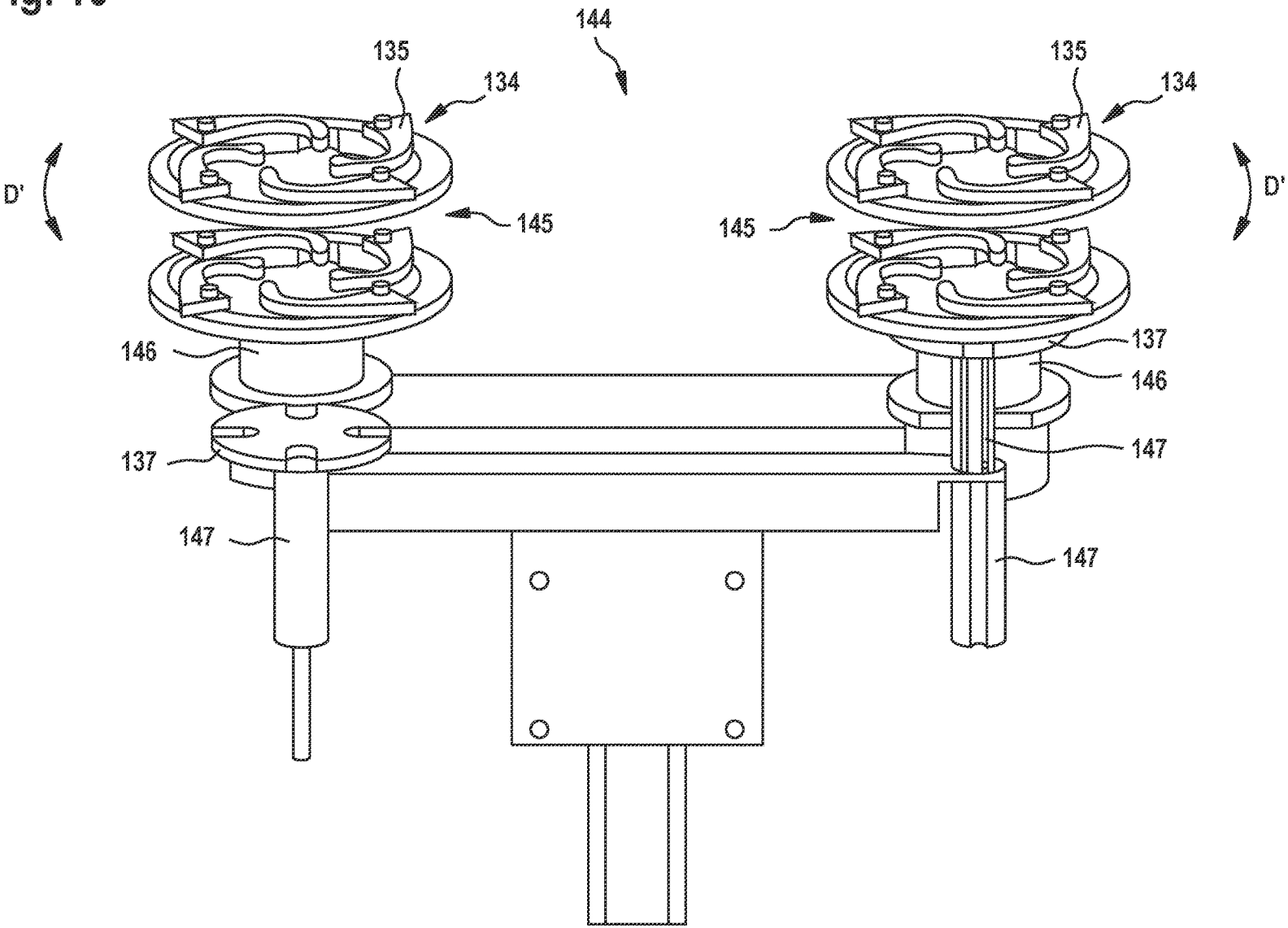
Figure 11:
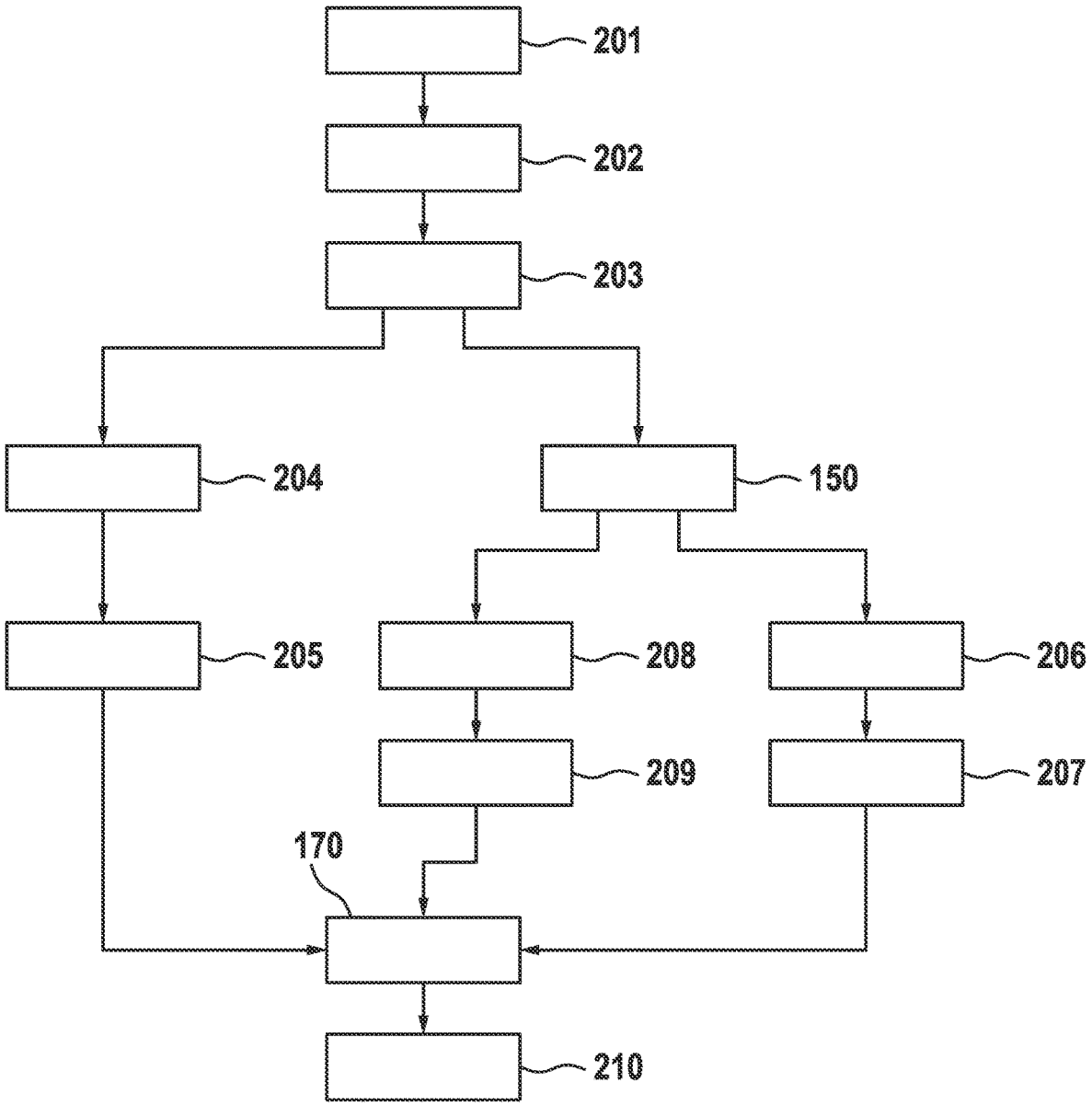

FIG. 7 a schematic representation of an example of a measuring device used according to the invention;

FIG. 8 a perspective view of the embodiment of the measuring device used according to the invention according to FIG. 7 in a loading position;

FIG. 9 a perspective view of the embodiment of the measuring device used according to the invention according to FIG. 7 in a measuring position;

FIG. 10 another embodiment of a subsection of the measuring device according to the invention according to FIG. 7;

FIG. 11 a block diagram of an embodiment of the method usable with the measuring device according to the invention according to FIG. 7.

Figure 12:
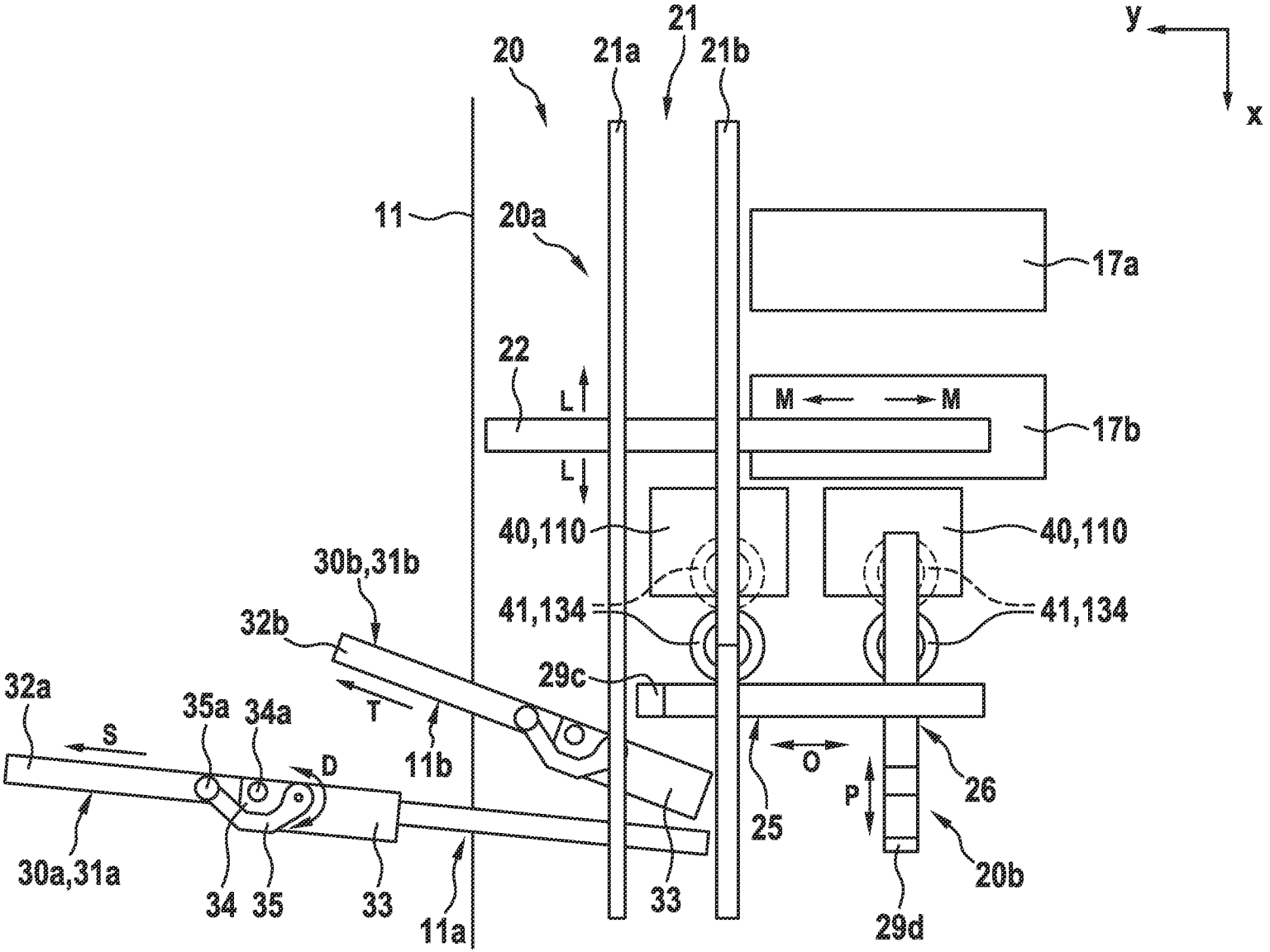
Figure 13:
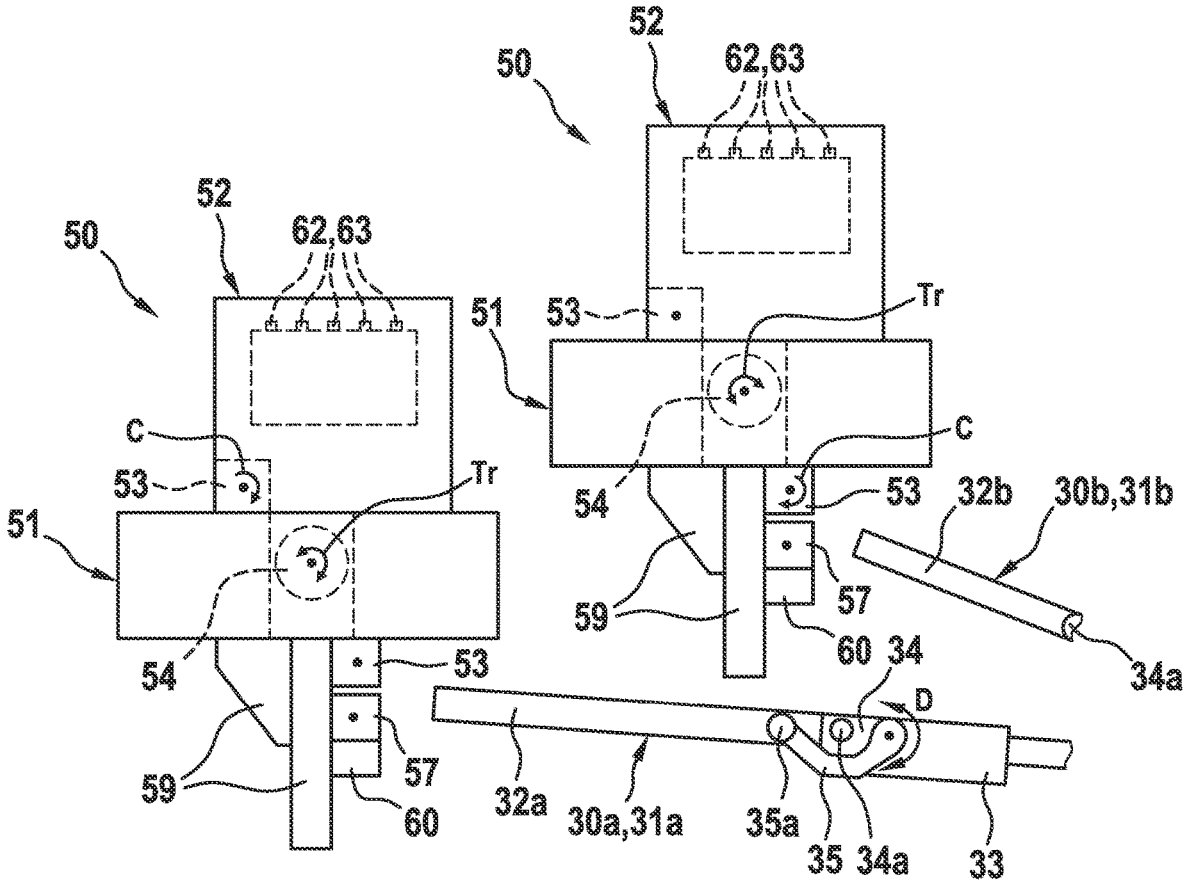
Figure 14A:
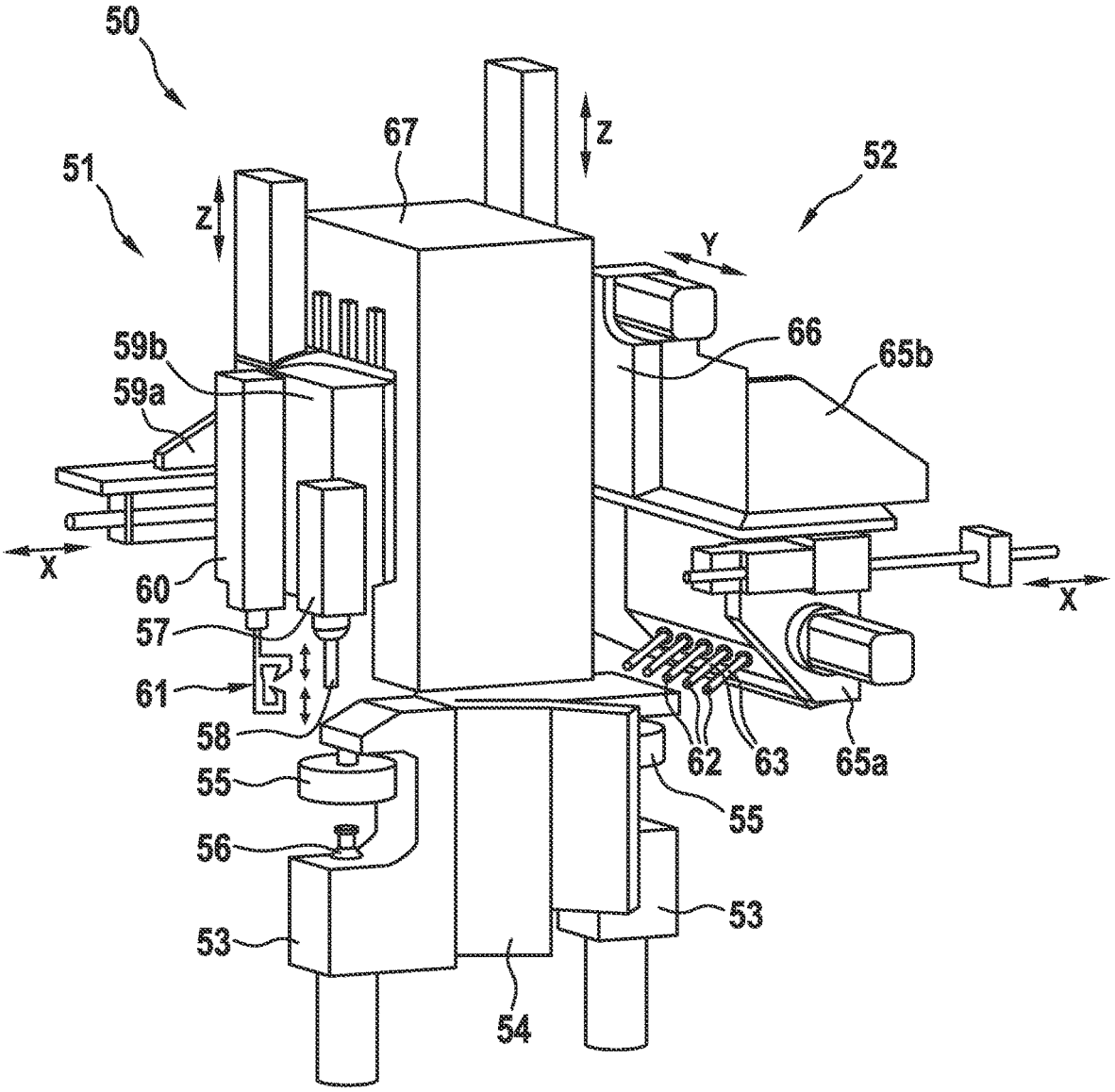
Figure 14B:
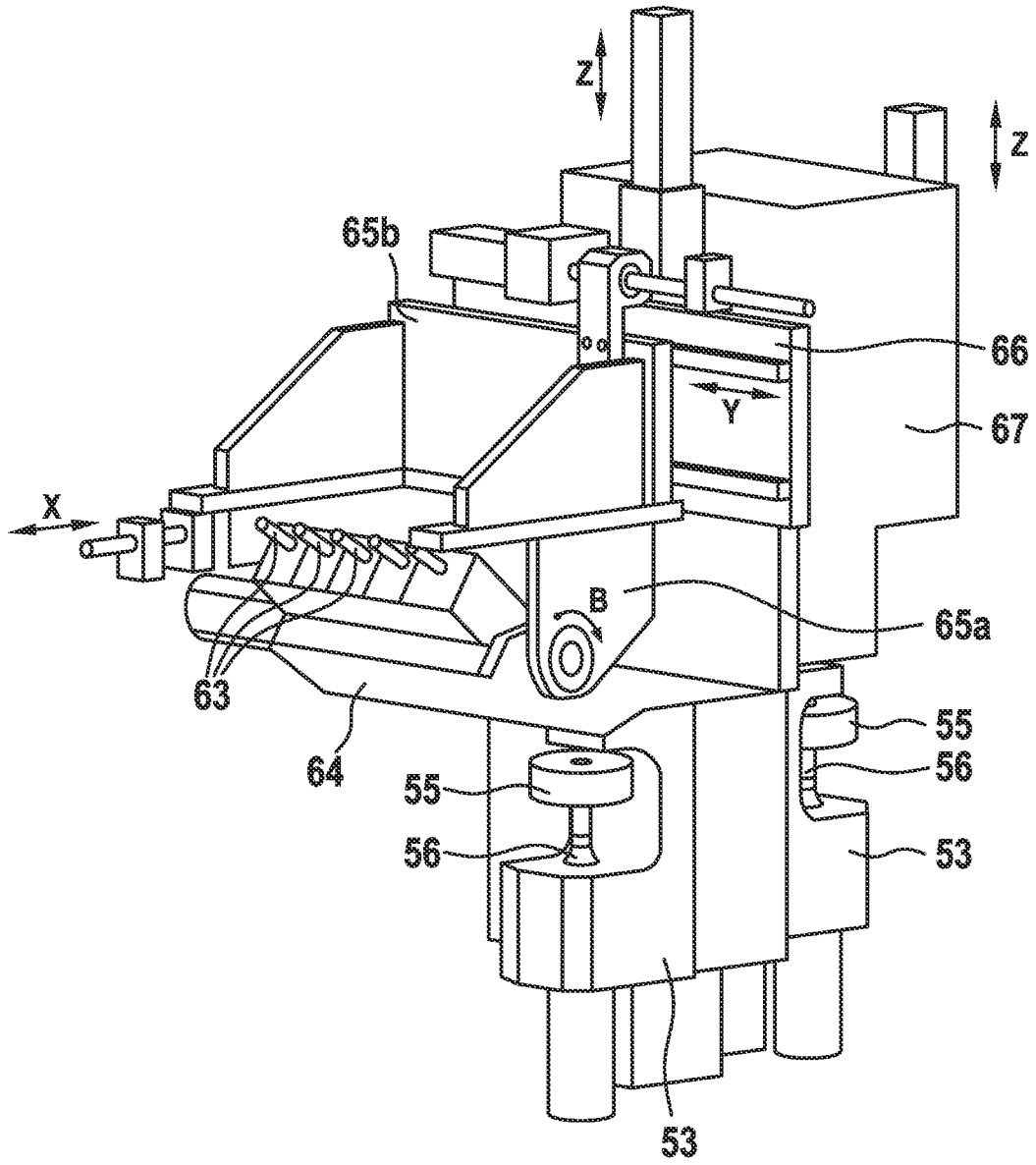
Figure 15:
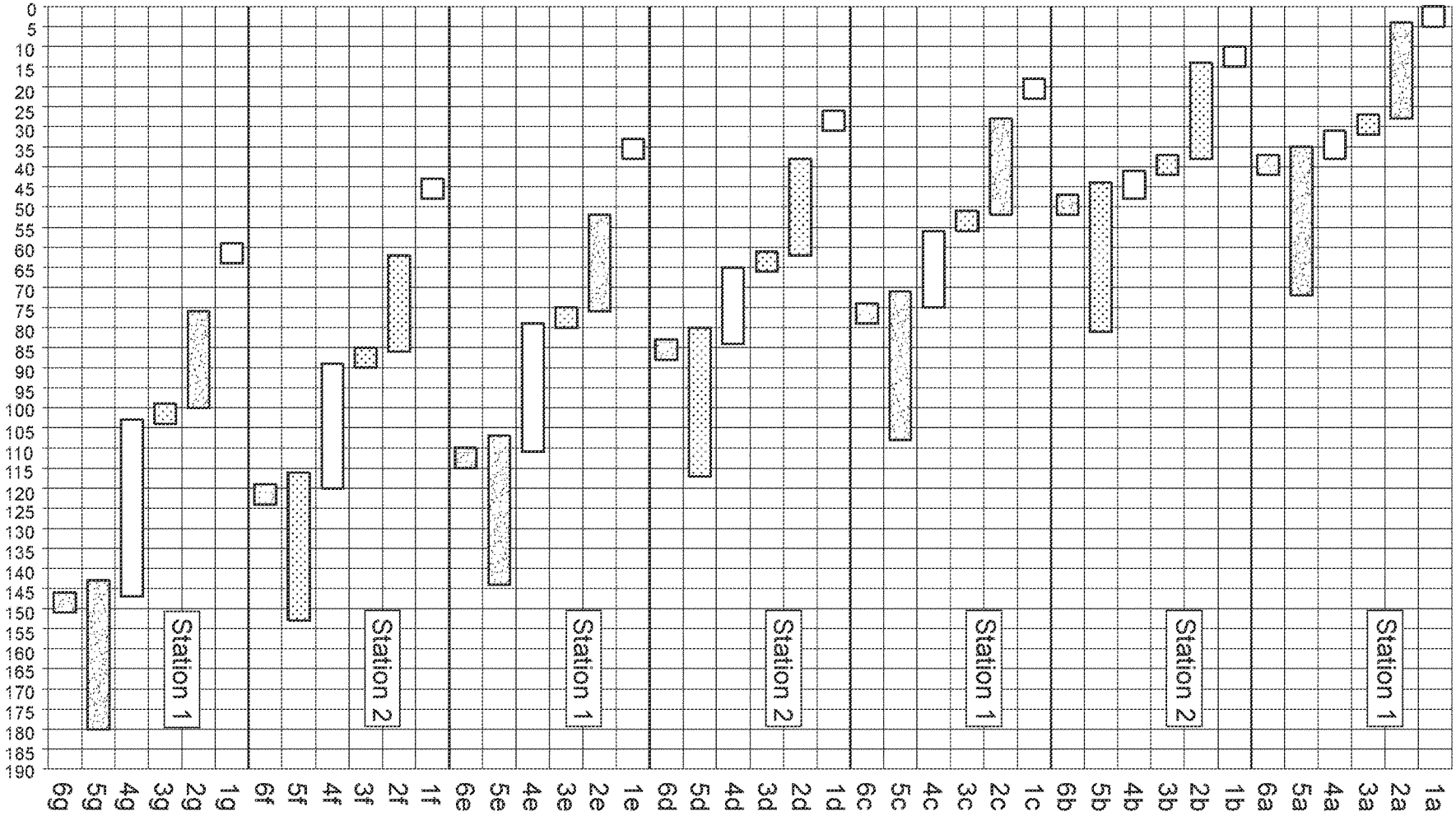

FIG. 12 the handling device or apparatus according to FIGS. 6*a*, 6*b* with embodiments of conveying devices for the apparatus according to the invention;

FIG. 13 the conveying devices according to FIG. 12 with embodiments of a processing device for the apparatus according to the invention;

FIG. 14*a* a first perspective view of an embodiment of a processing device for the apparatus according to the invention;

FIG. 14*b* the processing device according to FIG. 14*a* in a further perspective view;

FIG. 15 an exemplary time table for an embodiment of the method according to the invention.

FIGS. 1 to 5 show various embodiments of the apparatus according to the invention, with the same or comparable components being given the same reference signs.

FIG. 1 shows an example of the basic structure of a first embodiment of the apparatus 1 for lens processing according to the invention. In the exemplary embodiment, the apparatus 1 according to the invention serves for measuring and chip-removing edge-machining of lenses to be processed, in particular in such a way that finished edge-machined lenses, in particular for inclusion in spectacle frames (not shown), result according to specified production data and/or frame data.

The apparatus 1 according to the invention preferably has a housing 10, which is preferably substantially divided into a measuring area 10*a* and a processing area 10*b*.

The housing 10 serves in particular for safety at work, e.g. with regard to tool or spindle breakage, sound protection and protection against chip debris.

It can be designed in one piece or in several pieces, in particular divided into a housing part for the measuring area 10*a* and a housing part for the processing area 10*b* (not shown). Accordingly, the apparatus 1 according to the invention can be constructed on a single base frame or on a multi-part base frame, in particular a base frame part for the measuring area 10*a* and a base frame part for the processing area 10*b* (not shown).

In the measuring area 10*a*, at least one measuring device 40, 110 is provided for measuring and/or aligning the lenses to be processed, while in the processing area 10*b*, at least one processing device 50 is arranged for edge processing of the lenses, in particular by chip-removing edge-machining.

The measuring area 10*a* and the processing area 10*b* of the apparatus 1 according to the invention are preferably separated from each other by a partition wall 11. The partition wall 11 is intended to reduce contamination of the measuring area 10*a* with the chip waste produced during the chip-removing machining of the lenses at least to a minimum.

Preferably, at least one conveying device 30*a*, 30*b* passes through a respective opening 11*a*, 11*b* in the partition wall 11. The openings 11*a*, 11*b* are preferably provided with doors (not shown) which uncover the openings 11*a*, 11*b* prior to the passage of a lens transported by a conveying device 30*a*, 30*b* and close them again after passage.

The at least one conveying device 30*a*, 30*b* serves to transport the lenses to be processed from the at least one measuring device 40, 110, i.e., out of the measuring area 10*a*, to the at least one processing device 50, as well as to transport the finished processed lenses from the at least one processing device 50 back into the measuring area 10*a* of the apparatus 1 according to the invention.

Preferably, an external conveyor belt 12 is arranged adjacent to the measuring area 10*a* on the housing 10, which serves to feed the lenses to be processed to the apparatus 1 according to the invention or to transport the finished edge-processed lenses away from the apparatus 1 according to the invention.

The lenses are preferably accommodated in transport boxes 13.

The external conveyor belt 12 can preferably form part of a larger and/or more complex conveyor system, in particular a linear or annular conveyor system, for transporting lens blanks and partially and fully processed lenses to and from various processing devices (not shown). However, instead of the external conveyor belt 12, other transport devices for the lenses are also conceivable.

Further, an operating unit 14*a* attached to a swivel arm 14 is preferably arranged on the housing 10. The operating unit 14*a* preferably has a display device, in particular for displaying control menus and/or processing statuses of the lenses, and an input device, in particular for preferably centrally inputting control commands and/or display requests. By means of the operating unit 14*a*, the at least one conveying device 30, the at least one measuring device 40, 110 and the at least one processing device 50 can be monitored by an operator and/or controlled by means of data input. Furthermore, the processing statuses of the lenses can be monitored.

The swivel arm 14 serves for swiveling the operating unit 14*a* in any direction to any side of the housing 10 of the apparatus 1 according to the invention. Depending on the location of the operating unit 14*a* with respect to the housing 10 or to the at least one measuring device 40 and/or the at least one processing device 50, the operating unit 14*a* can be designed to display different display and/or control menus, for example for the at least one measuring device 40 and/or the at least one processing device 50.

The operation of the apparatus 1 according to the invention can of course also be realized by means of differently constructed or designed operating devices, in particular by means of wireless operating devices such as tablets, laptops, etc., which can preferably also display different display and/or control menus, for example for the at least one measuring device 40 and/or the at least one processing device 50, depending on their location with respect to the housing 10 or to the at least one measuring device 40 and/or the at least one processing device 50.

In a manner known per se, a switch cabinet 15 accommodates the components necessary for the power supply, operation and control of the apparatus 1 according to the invention.

FIG. 2 shows a plan view of a second embodiment of the apparatus 1' according to the invention. The housing 10 and the partition wall 11 between the measuring area 10*a* and the processing area 10*b* are shown only indicated for reasons of clarity.

The external conveyor belt 12 serves for conveying transport boxes 13 with lenses 16*a*, 160 to be processed for transport to the apparatus 1' according to the invention as well as to convey transport boxes 13 with finished processed lenses 16*b* for transport from the apparatus 1' according to the invention.

The transport boxes 13 are provided with data carriers 13*a*, e.g. barcodes, RFID chips or the like. The data carriers 13*a* can themselves contain production and/or frame data for the lenses 16*a*, 160 to be processed that are assigned to them. However, the data carriers 13*a* can also contain, for example, only identification data for the lenses 16*a*, 160 assigned to them, for example order numbers or the like. In this case, the production and frame data are stored, for example, in a control unit or a control center (see below) and linked to the respective identification data assigned to them.

The conveyor belt 12 is preferably in operative connection with two buffer belts 17*a*, 17*b* arranged in the measuring area 10*a* of the apparatus according to the invention, which form a buffer area 17. The buffer belts 17*a*, 17*b* can be designed, for example, as a roller conveyor or as a conveyor belt and, in the exemplary embodiment, provide space for up to eight transport boxes 13.

The buffer belt 17*a* preferably transports the transport boxes 13 away from the conveyor belt 12 and in the direction of the arrow E into the measuring area 10*a*, while the buffer belt 17*b* transports the transport boxes 13 in the direction of the arrow R out of the measuring area 10*a* in the direction of the conveyor belt 12.

The transport boxes 13 are pushed from the conveyor belt 12 onto the buffer belt 17*a* in a manner known per se, for example by means of a pusher 12*a*. The transport boxes 13 are also advanced on the buffer belts 17*a*, 17*b* in a manner known per se, e.g. by means of stop devices 18 (cf. FIGS. 6*a*, 6*b*).

The stop devices 18 can also be designed as pushers, for example, which are moveable transversely to the transport direction of the transport boxes 13 (i.e. transversely to the arrows E or R) in a manner known per se.

At the transition between the conveyor belt 12 and the buffer belt 17*a*, a reading device 19, for example a laser scanner, is preferably provided (cf. FIGS. 6*a*, 6*b*), which reads out the production data and/or frame data stored on the data carriers 13*a* for the lenses 16*a*, 160 to be processed located therein and transmits them to the control system of the apparatus 1' according to the invention.

A pusher can also be provided at the end of the buffer belt 17*a* (not shown) in order to push the transport boxes 13 in a manner known per se transversely to the transport direction of the transport boxes 13 (i.e. transversely to the arrows E or R) from the buffer belt 17*a* onto the buffer belt 17*b*.

The buffer area 17 or the buffer belts 17*a*, 17*b* preferably serve as buffer storage for the transport boxes 13.

This is particularly useful because the lenses 16*a*, 160 to be processed are not necessarily fed to their measurement and processing in the same order in which they arrive on the buffer belt 17*a*. Rather, later arriving lenses 16*a*, 160 to be processed can be measured and processed first, while earlier arriving lenses 16*a*, 160 to be processed are conveyed further in their transport boxes 13 along the arrows E and/or R until they are selected for measurement and processing by the control system of the apparatus 1' according to the invention. Lenses 16*a*, 160 arriving later can therefore "overtake", so to speak, lenses 16*a*, 160 already in the buffer area 17 with respect to the sequence of their measurement and processing. This has the advantage, for example, that lenses 16*a*, 160 with an above-average measuring and/or processing time, for example lenses that are complex to be measured and/or processed, are only selected for measurement and processing when they slow down the overall sequence of lens measurement and lens processing within the apparatus 1' according to the invention to the smallest possible extent.

As a result, subsequent lenses 16*a*, 160 can be conveyed to a free measuring device 40, 110 and/or to a free processing device 50 after a "waiting time" that is as short as possible and thus be fed to their measurement and processing. At the same time, "dead times" at the at least one measuring device 40, 110 and the at least one processing device 50 (i.e. waiting times without lens processing) are reduced as much as possible and, in the optimum case, completely avoided.

To support the buffer effect, it is also conceivable to provide a third conveyor belt (not shown) between the two buffer belts 17*a*, 17*b*, which is arranged running parallel to the buffer belts 17*a*, 17*b* and is known in principle, for example, from WO 2013/131656 A2. Such a third conveyor belt makes it possible, for example, to push transport boxes 13 preferably from the buffer belt 17*b* onto the third conveyor belt, in particular by means of a pusher (not shown) known per se, if the lenses 16*a*, 160 accommodated in the transport boxes 13 are not yet intended for measurement or processing. In this case, the third conveyor belt, like the buffer belt 17*a*, would transport the transport boxes 13 in the direction of the arrow E. As a result, the transport boxes 13 would then circulate on the third conveyor belt and the buffer belt 17*b*. Such a circulation of the transport boxes 13 is of course conceivable on the third transport and the buffer belt 17*a*. In this case, the third transport belt would transport the transport boxes 13 in the direction of the arrow R.

In the measuring area 10*a*, two measuring devices 40, 110 are provided in the exemplary embodiment, which are preferably identical in construction. Each of the measuring devices 40, 110 can measure a lens 16*a*, 160 to be processed, in particular so that the measured lenses 16*a* to be processed can be transferred in a manner known per se to the at least one processing device 50 in correct spatial orientation in order to obtain finished edge-processed lenses 16*b* corresponding to their respective production data and/or frame data.

In the exemplary embodiment, the two measuring devices 40, 110 are connected to two conveying devices 30*a*, 30*b*. The transfer of the lenses 16*a*, 160 to be processed from their transport boxes 13 to a freely selectable measuring device 40, 110 from the measuring device 40 to a freely selectable conveying device 30*a*, 30*b* as well as the transfer of the finished edge-processed lenses 16*b* from the conveying devices 30*a*, 30*b* back to their transport boxes 13 is carried out via a handling device or apparatus 20, as exemplarily shown in FIGS. 6*a*, 6*b* and 12 (see below).

The conveying devices 30*a*, 30*b* transport the measured and aligned lenses 16*a* to be processed, preferably while maintaining their spatial orientation, from the measuring area 10*a* to the processing area 10*b* of the apparatus 1' according to the invention.

As can also be seen from the exemplary embodiment according to FIG. 1, the conveying devices 30*a*, 30*b* preferably pass through openings 11*a*, 11*b* in the partition wall 11 between the measuring area 10*a* and the processing area 10*b*. The partition wall 11 is intended to at least minimize contamination of the measuring area 10*a* with the chip debris produced during the chip-removing edge machining of the lenses 16*a*. For this purpose, the openings 11*a*, 11*b* through which the conveying devices 30*a*, 30*b* pass are preferably provided with doors (not shown) which uncover the openings 11*a*, 11*b* prior to the passage of a lens 16*a*, 16*b* transported by a conveying device 30*a*, 30*b* and close them again after passage.

In the exemplary embodiment, two preferably identically constructed processing devices 50 are provided in the processing area 10*b*, which are connected to the conveying devices 30*a*, 30*b*.

In the exemplary embodiment, they are edge processing devices 50 that are each divided into a rough processing area 51 and a fine processing area 52.

The lens 16*a* to be processed is first subjected to an initial chip-removing edge machining operation in the rough processing area 51, in which the desired contour of the lens 16*a* is approximately produced.

The lens 16*a* pre-machined in this way is then preferably transferred to the fine processing area 52, where the desired contour is completed. The now finished edge-machined lens 16*b* is then preferably transferred again to a conveying device 30*a*, 30*b*, transported back to the measuring area 10*a* of the apparatus 1' according to the invention and deposited there again in the associated transport box 13.

To remove the chip waste produced during the edge machining of the lenses 16*a*, an aspiration opening 69 can be provided in the bottom of the processing area 10*b*, for example, to which an aspiration system with a pipeline for conveying away the chip waste is connected in a manner known per se.

Advantageously, the conveying devices 30*a*, 30*b* and the processing devices 50 are attached to a support frame spanning the processing area 10*b* (not shown) in order to reduce their contamination as far as possible and to enable the chip waste to be aspirated without difficulty. Then the floor of the processing area 10*b* can also be designed, for example, in the form of a trough 68, in particular to simplify the collection of the chip waste in the area of the aspiration opening 69. Then, if necessary, the aspiration process as such can also be designed discontinuously and thus in an energy-saving manner and with less noise nuisance.

Preferably, two lenses 16*a* can be processed at the same time in each processing device 50, wherein in each case one lens 16*a* is located in the rough processing area 51 and in each case one lens 16*a* is located in the fine processing area 52. Preferably, therefore, in this exemplary embodiment of the apparatus 1' according to the invention, two lenses 16*a* can be measured and four lenses 16*a* can be edge-processed at the same time and/or in a time-overlapping manner.

Preferably, the housing 10 surrounds the measuring devices 40, 110, the conveying devices 30*a*, 30*b*, the handling device 20, the processing devices 50 and/or the buffer area 17, in particular laterally and/or completely.

FIG. 3 shows a plan view of a third embodiment of the apparatus 1" according to the invention. The apparatus 1" corresponds essentially to the apparatus 1' according to FIG. 2 and has essentially the same components. Therefore, the same reference signs have been used in this respect, and reference is made in this respect to the above description relating to FIG. 2.

The essential difference between the apparatus 1' according to the invention as shown in FIG. 2 and the apparatus 1" according to the invention as shown in FIG. 3 is that the measuring devices 40, 110 are not arranged next to each other but offset to each other. Consequently, the conveying devices 30*a*, 30*b* are arranged parallel to each other and connect the measuring devices 40, 110 with one processing device 50 each.

The transfer of the lenses 16*a*, 160 to be processed from their transport boxes 13 to a freely selectable measuring device 40, 110, from the measuring device 40, 110 to a freely selectable conveying device 30*a*, 30*b*, as well as the transfer of the finished processed lenses 16*b* from the respective conveying device 30*a*, 30*b* back to their transport boxes 13 takes place via a handling device or apparatus 20, as exemplarily shown in FIGS. 6*a*, 6*b* and 11 (see below).

FIG. 4 shows a top view of a fourth embodiment of the apparatus 1'" according to the invention.

The apparatus 1'" essentially corresponds to the apparatus 1' according to FIG. 2 and has essentially the same components. Therefore, the same reference signs have been used in this respect and reference is made in this respect to the above description relating to FIG. 2.

The essential difference between the apparatus 1' according to the invention as shown in FIG. 2 and the apparatus 1'" according to the invention as shown in FIG. 4 is that several, in the exemplary embodiment two, measuring devices 40, 110 are provided, to which a measuring table 42 is assigned for receiving the lenses 16*a*, 160 to be processed. The conveying devices 30*a*, 30*b* are arranged parallel to one another and connect the measuring table 42 to one processing device 50 in each case. The lenses 16*a*, 160 to be processed are removed from their transport boxes 13, deposited on the measuring table 42 for measurement and fed to the respective measuring devices 40, 110 by means of rotation of the measuring table 42. After measurement, the measured lenses 16*a* still to be processed are transferred to the conveying devices 30*a*, 30*b* while retaining their orientation; conversely, the finished processed lenses 16*b* are transported back to the measuring area 10*a* by the conveying devices 30*a*, 30*b* and transferred to their assigned transport boxes 13.

The transfer of the lenses 16*a* to be processed from their transport boxes 13 to the measuring table 42, from the measuring table 42 to a freely selectable conveying device 30*a*, 30*b*, as well as the transfer of the finished processed lenses 16*b* from the respective conveying device 30*a*, 30*b* back to their transport boxes 13 is carried out by a handling device or apparatus 20, as exemplarily shown in FIGS. 6*a*, 6*b* and 11 (see below).

FIG. 5 shows a top view of a fifth embodiment of the apparatus 1"" according to the invention. The apparatus 1"" is essentially the same as the apparatus 1' shown in FIG. 2 and has essentially the same components. Therefore, the same reference signs have been used in this regard, and reference is made to the above description of FIG. 2 in this respect.

The essential difference between the apparatus 1' according to the invention as shown in FIG. 2 and the apparatus 1"" according to the invention as shown in FIG. 5 is that the measuring devices 40, 110 and the processing devices 50 are arranged rotated by 90°. This allows the housing 10"" to be of shortened design, as indicated by means of the dashed line.

The transfer of the lenses 16*a*, 160 to be processed from their transport boxes 13 to a freely selectable measuring device 40, 110, from the measuring device 40, 110 to a freely selectable conveying device 30*a*, 30*b*, as well as the transfer of the finished processed lenses 16*b* from the respective conveying device 30*a*, 30*b* back to their transport boxes 13 takes place via a handling device or apparatus 20, as exemplarily shown in FIGS. 6*a*, 6*b* and 11 (see below).

FIGS. 2 to 5 thus show by way of example the construction principle by which the apparatus 1, 1', 1", 1'", 1"" according to the invention is characterized. This construction principle comprises the arrangement of at least one measuring device 40, 110 with at least one processing device 50 and their connection by means of at least one conveying device 30*a*, 30*b*.

As a result, in the exemplary embodiment, lenses 16*a*, 160 to be processed are measured and edge-processed to obtain finished processed lenses 16*b* according to defined production data and/or frame data, which can then be inserted into eyeglass frames.

The number of measuring devices 40, 110 and processing devices 50 to be combined can be selected as desired, depending on, for example, the choice of design and/or mode of operation of the respective measuring devices 40, 110 and processing devices 50, their measuring or processing speed per lens 16*a*, 160 etc.

The measuring devices 40, 110 and processing devices 50 can be arranged or oriented relative to each other in the apparatus 1, 1', 1", 1''', 1'''' any way, for example depending on their size and/or their construction.

The design and the number of the conveying devices 30*a*, 30*b* can then be selected depending on the number and, if necessary, also on the arrangement of the measuring devices 40, 110 and processing devices 50 in the respective apparatus 1, 1', 1", 1''', 1''''.

In the exemplary embodiments according to FIGS. 2 to 5, two measuring devices 40, 110 and two processing devices 50 each with a rough processing area 51 and a fine processing area 52 were selected. However, this selection can be changed, varied and/or extended as desired. Therefore, the installation of a buffer area 17 with buffer belts 17*a*, 17*b* is advantageous in order to keep sufficient lenses 16*a* to be processed in stock and/or to transport away finished lenses 16*b* quickly in order to avoid delays in measuring and/or processing the lenses 16*a*, 160 to be processed as far as possible.

FIGS. 6*a*, 6*b* and 12 show an embodiment of a handling device or apparatus 20 for lenses 16*a*, 160 16*b*.

In the exemplary embodiment, the handling device or apparatus 20 is assigned to the measuring area 10*a* of the apparatus 1, 1', 1", 1''', 1'''' according to the invention.

FIG. 6*a* shows the handling device or apparatus 20 in a top view or in the direction of arrows VIa, VIa in FIG. 6*b*. Accordingly, FIG. 6*b* shows the handling device or apparatus 20 in a side view or in the direction of arrows VIb, VIb in FIG. 6*a*. FIGS. 6*a*, 6*b* further show the stop devices 18 arranged between the buffer belts 17*a*, 17*b* for controlling the advancement of the transport boxes 13 for the lenses 16*a*, 160, 16*b* on the buffer belts 17*a*, 17*b*. Finally, FIGS. 6*a*, 6*b* also show a reading device 19 for reading out the production data and/or frame data stored on the data carriers 13' for the lenses 16*a*, 160 to be processed located in the associated transport boxes 13.

The handling device or apparatus 20 has a first handling unit 20*a*. The first handling unit 20*a* preferably serves on the one hand for transferring lenses 16*a*, 160 to be processed from their transport boxes 13 assigned to them, in particular located on the buffer belts 17*a*, 17*b*, to the lens holders 41, 134 assigned to the respective measuring devices 40, 110.

The first handling device or handling unit 20*a* is further preferably used for transferring finished lenses 16*b* from the conveyors 30*a*, 30*b* back to their respective associated transport boxes 13 (see below for details).

For this purpose, the first handling unit 20*a* in the exemplary embodiment preferably has a first rail 21 with two guides 21*a*, 21*b*, on which a second rail 22 is arranged at right angles and is guided in the guides 21*a*, 21*b* in a manner known per se. The second rail 22 is movable in a direction indicated by the arrow L (in the direction of the coordinate x) along the first rail 21—in the exemplary embodiment electrically driven by means of a motor 29*a*. A gripping device 23 movable in a direction indicated by the arrow M (in the direction of a coordinate y)—in the exemplary embodiment electrically driven by means of a motor 29*b*—is arranged and guided on the second rail 22. The gripping device 23 has a gripper or suction cup 24—in the exemplary embodiment pneumatically driven—movable in a direction indicated by the arrow N (in the direction of a coordinate z) for gripping or sucking the lenses 16*a*, 160, 16*b*.

The handling device or apparatus 20 further preferably comprises a second handling unit 20*b*. The second handling unit 20*b* is used in particular for transferring measured lenses 16*a* still to be processed from the respective lens holders 41, 134 assigned to the measuring devices 40, 110 to the freely selectable conveying devices 30*a*, 30*b* (see also FIG. 11).

For this purpose, the second handling unit 20*b* in the exemplary embodiment preferably has a first rail 25, on which a second rail 26 is arranged and guided in a manner known per se. The second rail 26 is movable in a direction indicated by the arrow O (in the direction of a coordinate y) along the first rail 25, in the exemplary embodiment by means of an electric drive motor 29*c*. A gripping device 27 is arranged on the second rail 26 in a direction indicated by the arrow P (in the direction of a coordinate x)—in the exemplary embodiment electrically movable by means of a motor 29*d*—and guided in a manner known per se. The gripping device 27 has a gripper or suction cup 28—in the exemplary embodiment pneumatically driven—movable in a direction indicated by the arrow Q (in the direction of a coordinate z) for gripping or sucking the lenses 16*a*.

The handling units 20*a*, 20*b* of the handling device or apparatus 20 are preferably attached to a—not shown—support frame of the apparatus 1, 1', 1", 1''', 1'''' according to the invention.

The at least one measuring device 40, 110 can be of any design and operate, for example, by means of mechanical scanning or contactless scanning. In the exemplary embodiment, the at least one measuring device is designed for contactless measurement of the lenses to be processed by means of deflectometry and/or transmission measurement and/or luminescence radiation. For this purpose, each lens 16*a* to be processed is received in a lens holder 41.

In the exemplary embodiment, pairs of lens holders 41 are provided that can be pivoted relative to each other. Thus, the lens holder 41 of one pair can be loaded with a lens 16*a* while the second lens holder 41 of the pair, loaded with a lens 16*a*, is located within the measuring device 40, 110. Each lens holder 41 may have, for example, a circular frame 41*a* with three or four gripping elements (not shown) as described, for example, in WO 2016/095939 A1.

FIGS. 7 to 11 show an embodiment of a measuring device 110 or of the measuring method that can be used with such a measuring device 110.

According to FIG. 7, the exemplary embodiment serves to measure a lens 160 having a top side 161 that is convex in the exemplary embodiment and a bottom side 162 that is concave in the exemplary embodiment.

The lens 160 may further be provided with a coating 160' in a manner known per se, for example an anti-reflective coating and/or a hard coating (hardcoat).

According to the invention, the device 110 comprises at least a first radiation source 140, possibly a further radiation source 140' with an upstream slit diaphragm or mask 143' for generating a radiation pattern, a second radiation source 150 and/or a measuring and/or detection device 120.

The orientation of a measuring and/or detection unit, for example the camera objective 123 of a camera 122 of the measuring and/or detection device (see below) defines a measuring axis M'.

The device 110 can be arranged on a frame, a holder or a work table in a manner known per se. However, the device can also be integrated, for example, in a device for processing, for example, for shaping an optically active object, for example, an optical lens, in particular an ophthalmic lens.

As can be seen from FIGS. 8 and 9, an exemplary embodiment of a device 110 according to the invention has a holding table 111 with a bottom side 112 and a top side 113.

A camera unit 120 is preferably attached to the holding table 111, in particular its bottom side 112. The camera unit 120 has a holder 121 on which a camera 122 (in the exemplary embodiment a camera with a CCD sensor) with a camera objective 123 is held.

The camera objective 123 is preferably oriented vertically upward.

In the exemplary embodiment, the camera 122 is provided with a polarizing filter (not shown). Therefore, a motor 124, in the exemplary embodiment an electrically driven stepper motor, is arranged above the camera objective 123 on the holder 121 for rotating the polarizing filter. The polarizing filter is used in a manner known per se to determine the direction of polarization of a polarized lens 160.

Further, the camera 122 or camera objective 123 preferably has filter means (not shown) for absorbing and/or deflecting the excitation radiation emitted by the laser diodes 141 (see below).

An opening 124 in the holder 121 and a recess 114 in the holder table provide a free measuring path for the camera objective 123 in the vertical direction, defining a vertically extending measuring axis M'.

A holding element 115 is preferably arranged on the holding table 111, in particular on its top side 113. A rack-and-pinion gear with a drive unit 116 having a motor is held on the holding element 115. The drive unit 116 moves a toothed rack 117 along a movement axis z' (hereinafter: z' axis) in a manner known per se. The z' axis and the measuring axis M' run parallel to each other in the vertical direction in the exemplary embodiment.

A holding plate 131 of a gripping unit 130 is preferably arranged stationary at the lower end of the rack 117. The holding plate 131 is attached to a guide shoe 133*a*. The guide shoe 133*a* is guided on a guide rail 133*b*, preferably free of play, e.g. pretensioned in a rolling manner known per se). The guide rail 133*b* is attached to a guide plate 132, which in turn is held on the holder 115.

A gripping device 134, as known for example from WO 2016/095939 A1, in the exemplary embodiment a centering/gripping device, with movable gripping elements 135 is preferably attached to the holding plate 131. The gripping device 134 is used for gripping and centering the lens 160. With the aid of the rack-and-pinion gear, the holding plate 131 and thus the gripping device 134 can be moved vertically along the guide rail 133*b* in the direction of the z' axis.

In the exemplary embodiment, the gripping elements 135 can be moved pneumatically. A pneumatic cylinder drive 136 for moving the gripping elements 135 is therefore provided below the holding plate 131 in the exemplary embodiment.

A deposit table 137 is preferably arranged below the gripping device 134. The deposit table 137 is preferably arranged on a bearing and swiveling device 139 by means of a holding arm 138 so that it can be swiveled about a swiveling axis S' running parallel to the z' axis and/or parallel to the measuring axis M' (in the example, pneumatically by means of a drive cylinder 139').

Preferably, a first radiation source 140 is further provided on the top side 113 of the holding plate 111. In the exemplary embodiment, this first radiation source 140 consists of two groups 140*a*, 140*b* of four laser diodes 141 each. In the exemplary embodiment, the laser diodes 141 of each group 140*a*, 140*b* are arranged parallel to each other in two rows each and at an angle of 15° to the z' axis or to the measurement axis M'. The laser diodes 141 may be provided with suitable elements for generating line-shaped radiation, for example cylindrical lenses, raster lenses, diffractive optical elements (DOE). It is also possible to use computer generated holograms (CGH). In the exemplary embodiment, the laser diodes 141 are further arranged offset from each other. As a result, the line-shaped rays emitted by the laser diodes 141 are also offset or spaced apart from each other perpendicular to their propagation direction.

In the exemplary embodiment, the distance between the line-shaped rays is approx. 10 mm.

The two groups 140*a*, 140*b* of laser diodes 141 are again arranged at right angles to each other. The laser diodes 141 are connected to a power supply device (not shown) via lines 142 in such a way that they can be switched independently of one another and in any combination.

A receiving plate 151 for receiving a second radiation source 150 is preferably arranged below the drive unit 116 for the rack-and-pinion gear. In the exemplary embodiment, a TFT-based liquid crystal flat panel display is provided as the second radiation source 150. The second radiation source 150 is preferably arranged above the gripping device 134 and is arranged in a plane oriented perpendicular to the z' axis or the measurement axis M'.

The measuring device 110 may also consist of two parts, each having a camera 122, a first radiation source 140 and a second radiation source 150, as described above. Then, a gripping and centering arrangement 144 may be provided, as exemplarily shown in FIG. 10.

The arrangement 144 has a total of two pairs 145 of in each case two gripping devices 134 with gripping elements 135 as described above. Each pair 145 of gripping devices 134 is assigned to a part of the measuring device 110 with a camera 122, a first radiation source 140 and/or a second radiation source 150 in each case.

The pairs 145 and/or gripping devices 134 of a pair 145 are preferably arranged in a common, in particular horizontal, plane. This is also evident from FIG. 12, in which four gripping devices 134 are shown on the right side of the figure.

Each pair 145 of gripping devices 134 is preferably mounted on a rotating device 146 so as to rotate 180° in the direction of the arrows D.

In other words, the pairs 145 of gripping devices 134 are each rotatable about a preferably vertical axis, in particular by 180°, especially preferably so that the gripping devices 134 of a pair exchange their positions during a rotation by 180°. Preferably, the rotating device 146 forms the axis of rotation for the pair 145. The rotating device 146 is preferably arranged below the gripping devices 134 and/or between the two gripping devices 134 of the pair 145.

Each pair 145 of gripping devices 134 is further preferably associated with a respective deposit table 137 as described above. Preferably, each deposit table 137 is designed to be height-adjustable by means of an adjustment device 147 and/or arranged or arrangeable in such a way that it is in a loading position according to FIG. 8 (right half of FIG. 10) or in a measuring position according to FIG. 9 (left half of FIG. 10) with respect to its assigned gripping device 134.

The second gripping device 134, which is arranged in the image background in each case in FIG. 10, is preferably positioned with respect to its assigned elements camera 122, first radiation source 140 and/or second radiation source 150 in such a way that a measurement (described in further detail below) can take place.

In the position according to the right half of FIG. 10, the front gripping device 134 can be loaded or unloaded with a lens 160 to be measured, as described below, while a lens (not shown) is held and measured in the rear gripping device 134.

In the position according to the left half of FIG. 10, a lens 160 to be measured can be held in the front gripping device 134 and a finished measured lens 160 can be held in the rear gripping device 134 (not shown), so that this pair 145 can be rotated 180°. Then, the lens 160 to be measured can be measured as described below, while the finished measured lens 160 can be unloaded as described below.

In the following, an example of the measurement method is described (cf. FIGS. 8, 9 and 11):

At the beginning of the process, the gripping device 134 of the device 110 according to the invention is preferably in its loading position (cf. FIG. 8, FIG. 10 right). In this loading position, the deposit table 137 is preferably arranged directly below the gripping device 134.

First, in method step 201, the device 110 is loaded (cf. WO 2016/095939 A1) with an optically active element to be measured, in the exemplary embodiment a lens 160 possibly provided with a coating 160', for example for a spectacle lens, in a manner known per se by placing it on the deposit table 137. Herein, the lens 160 is preferably oriented in such a way that its bottom side 162, which is concave in the exemplary embodiment, is oriented towards the camera objective 123 and its top side 161, which is convex in the exemplary embodiment, is oriented towards the second radiation source 150.

Further, in method step 202, the gripping elements 135 are first actuated such that the lens 160 is centered along its circumference within the gripping device 134 with respect thereto.

Subsequently, in method step 202, the gripping elements 135 of the gripping device 134 are actuated such that the lens 160 is clamped by means of the gripping elements 135 while substantially maintaining the centering of the lens 160.

Now, in method step 203, the gripping device 134 is first moved upward along the z' axis to such an extent that the deposit table 137 can be swiveled out of the measuring area of the camera objective 123 of the camera 122 in order to clear the measuring axis M' for the camera objective 123.

Finally, in method step 203, the gripping device 134 together with the lens 160 clamped therein is moved further upward along the z' axis toward the second radiation source 150 by means of the rack-and-pinion gear.

The gripping device 134 of the device 110 according to the invention is now in a defined measuring position (cf. FIG. 9, FIG. 10 left). This measuring position can remain unchanged regardless of the properties of the optically active element to be measured, in order to contribute to the standardization of the method according to the invention.

Three measuring methods can be carried out successively or simultaneously (see FIG. 10):

1. Determination of the spatial position of the bottom side 162 of the lens 160

In the method step 204, each laser diode of the two groups 140*a*, 140*b* of laser diodes 141 emits a line-shaped ray, in the exemplary embodiment excitation radiation with a wavelength of 405 nm or 450 nm. These defined wavelengths can be filtered out of the radiation emitted by the laser diodes 141, for example by means of a filter that is not shown.

The line-shaped rays emitted by the laser diodes 141 have a spacing of about 10 mm due to the arrangement of the laser diodes 141 perpendicular to their propagation direction with respect to each other. As a result, the line-shaped rays emitted by all eight laser diodes in the exemplary embodiment impinge on the material of the lens 160 and/or its coating 160' in the form of a line pattern of two groups of four lines each arranged at right angles to each other. The fluorescence radiation of the material of the lens 160 and/or its coating 160' with a wavelength of more than 405 nm or 450 nm excited by the line-shaped rays arranged in this way is therefore emitted in the form of two groups of four lines each arranged at right angles to one another and spaced apart from one another (i.e. in the form of a grid or check pattern).

In the exemplary embodiment, two groups of four line-shaped rays, each arranged at right angles to one another, impinge on the bottom side 162 of the lens 160, which is concave in the exemplary embodiment. The fluorescent radiation emitted by the material of the lens 160 and/or its coating 160' thus forms a check or grid pattern of two times four fluorescent lines with a wavelength of, in the exemplary embodiment, more than 405 nm or 450 nm. This fluorescent radiation is captured by the camera objective 123 in method step 205 and detected by a CCD sensor of the camera 122 in the exemplary embodiment. If the camera 122 or the camera objective 123 has a filter for absorbing or deflecting the excitation radiation emitted by the laser diodes 141, the fluorescence radiation can be detected particularly reliably and with low interference. The resulting measurement data are fed to an evaluation unit 170.

The measurement data are evaluated by means of a triangulation method (fringe projection as a 3D measurement method) known per se. In this way, the spatial position of the bottom side 162 of the lens 160, which is concave in the exemplary embodiment, is determined in a manner known per se. For non-symmetrical lenses (e.g. free-form lenses), the measurement result is unambiguous. In the case of symmetrical lenses (e.g. spherical lenses), data on their edge contour (see below) are still required to determine their position in space.

The device 110 according to the invention can be calibrated by carrying out the method described above using a flat glass as a measurement object.

2. Determination of parameters of the lens 160

In method step 206, the second radiation source 150 (in the exemplary embodiment a TFT-based LCD screen) emits rays in a defined pattern (e.g., a stripe pattern) in the direction of the top side 161 of the lens 160, which is convex in the exemplary embodiment. The rays pass through the lens 160, wherein the defined pattern is changed according to the parameters of the lens 160, in particular its contour, its edge contour, any markings (e.g. laser engravings) and/or any multi-focal zones (e.g. bifocal or trifocal zones) of the lens 160. In method step 207, the resulting transmission radiation is captured by the camera objective 123 of the camera 122 and, in the exemplary embodiment, detected in the form of measurement signals by means of the CCD sensor of the camera 122. The measurement data resulting from this transmission measurement are fed to the evaluation unit 170 and evaluated.

The device 110 according to the invention can be calibrated by carrying out the method described above using a flat glass as a measurement object.

3. Determination of the refractive power of the lens 160

In method step 208, the second radiation source 150 (in the exemplary embodiment a TFT-based LCD screen) emits rays in the form of defined pixels in the direction of the top side 161 of the lens 160, which is convex in the exemplary embodiment. The rays pass through the lens 160, wherein they are deflected depending on the optical properties of the lens 160. The resulting transmission radiation is captured by the camera objective 123 of the camera 122 in the method step 209 and detected in the form of measurement points by means of the CCD sensor of the camera 122 in the exemplary embodiment.

For evaluation of the measurement points, a ray tracing method known per se is used in the exemplary embodiment (i.e. an algorithm based on the emission of rays for tracing the determined measurement points back to their source, i.e. the defined pixels). By means of the ray tracing method, the resulting measurement points detected by the CCD sensor of the camera 122 are correlated with the pixels arranged on the second radiation source 150 (i.e., the source points of the rays detected in the form of measurement points). For the purpose of assigning the measurement points captured by the CCD sensor to the pixels defined in the second radiation source 150, the second radiation source 150 is coded accordingly in a manner known per se. The measurement data resulting from the transmission measurement and the ray tracing method are fed to the evaluation unit 170. In this measurement method, it is advantageous if the defined pattern of the rays emitted by the second radiation source 150 is selected in such a way that sufficient signal separation, i.e. sufficient resolution of the measurement signals, is achieved at the CCD sensor so that, in the optimum case, each measurement signal can be evaluated.

The evaluation of the measurement data gives the refractive power of the lens 160.

The device 110 according to the invention can be calibrated by carrying out the procedure described above using a flat glass as a measurement object.

The linking of these measurement data allows the determination of a two-dimensional evaluation of the refractive power of the lens 160 (so-called "power map") in method step 210. This makes it possible, among other things, to distinguish between prisms incorporated into the lens 160 in accordance with the order and prism defects. This applies both to prism errors that have arisen during the shaping processing of the bottom side 162 of the lens 160 and to prism errors that are detected due to incorrect positioning of the lens 160 in the device 110.

The methods described above for determining the spatial position of the lens 160 (item 1) and for determining its parameters (item 2) can also be performed deflectometrically. For this purpose, radiation emitted by a radiation source to which the lens 160 is opaque is used. The radiation source is positioned in such a way that the lens 160 reflects the radiation emitted by the radiation source in the direction of the measurement axis M', i.e. in the direction of the camera objective 123, so that the resulting reflection radiation can be captured by the camera objective 123 and detected by the CCD sensor of the camera 122. The evaluation of the resulting measurement data is then performed in a manner known per se.

FIGS. 12 and 13 show in a plan view an exemplary embodiment of conveying devices 30*a*, 30*b*, which preferably cooperate with the handling device or apparatus 20 in the measuring area 10*a* and/or the two processing devices 50 in the processing area 10*b* of the apparatus 1, 1', 1", 1''', 1'''' according to the invention.

In the exemplary embodiment, the conveying devices 30*a*, 30*b* are designed as linear conveyors 31*a*, 31*b* and are preferably attached to a—not shown—support frame of the apparatus 1, 1', 1", 1''', 1'''' according to the invention.

In the exemplary embodiment, each linear conveyor 31*a*, 31*b* has in a manner known per se a guide rail 32*a*, 32*b* for guiding a carriage 33. In the exemplary embodiment, the carriage 33 is arranged on the guide rail 32*a*, 32*b* pneumatically driven so as to be movable in the direction of the arrow S (conveying device 30*a*) or in the direction of the arrow T (conveying device 30*b*). However, the carriage 33 can also be driven electrically.

A rigid holder 34 with a first gripper or suction pad 34*a* and/or a holder 35 with a second gripper or suction pad 35*a*, which can be pivoted about a pivot axis D, are preferably arranged on the carriage 33.

The first gripper or suction cup 34*a* preferably serves to receive the lens 16*a* which has been measured and aligned for edge processing, while the second gripper or suction cup 35*a* preferably serves to receive the finished edge-processed lens 16*b*.

Therefore, the first gripper or suction cup 34*a* is preferably designed in a manner known per se such that it can receive the lens 16*a*, which has been finished measured and aligned for edge processing, in its respective alignment and that this alignment is maintained during the transport of the lens 16*a* to the processing device 50.

In contrast, the second gripper or suction cup 35*a* may be of simple design, such that it can receive the finished edge-processed lens 16*b* in any orientation.

In the exemplary embodiment, the axes x, y and z mentioned below are oriented orthogonally to each other, preferably with the x-axis and the y-axis being horizontal and the z-axis being vertical (see also FIGS. 6*a*, 6*b*).

FIGS. 13 to 14*b* show an exemplary embodiment of a processing device 50 according to the invention, which is preferably suitable for use in the apparatus 1, 1', 1", 1''', 1'''' according to the invention and/or for carrying out the method according to the invention. In the exemplary embodiment, two processing devices 50 according to the invention of identical construction are provided.

In the exemplary embodiment, the two processing devices 50 are attached to a support frame (not shown), in particular at a distance from the trough 68 or the aspiration opening 69, in order to ensure undisturbed drainage of the chip waste.

Each processing device 50 preferably has a rough processing area 51 and a fine processing area 52, so that two lenses 16*a* can be edge-processed simultaneously and/or overlapping in time.

The processing device 50 is preferably designed for simultaneous processing of lenses in the rough processing area 51 and fine processing area 52.

In the exemplary embodiment, the rough processing area 51 also serves as a loading area for lenses 16*a* to be processed or as an unloading area for finished edge-processed lenses 16*b*.

Preferably, two workpiece spindles or one-piece spindle housings 53 are provided in each processing device 50.

In the exemplary embodiment, the two workpiece spindles or one-piece spindle housings 53 are arranged in such a way that they can be rotated by 180° about an axis of rotation Tr in the exemplary embodiment.

Preferably, the workpiece spindles 53 or one-piece spindle housings 53 are arranged on a rotating device 54, in particular offset from each other.

Thus, each workpiece spindle or one-piece spindle housing 53 is arranged to be transferable from the rough processing area 51 to the fine processing area 52 and back.

The preferred offset arrangement of the two workpiece spindles or one-piece spindle housings 53 has the effect of minimizing the radius ("flight circle") defined by the 180° rotation.

In other words, the processing device 50 has a spindle device with two workpiece spindles 53, which are formed in particular by the one-piece spindle housings 53. The workpiece spindles or one-piece spindle housings 53 are preferably each configured to hold a lens during a processing operation. The spindle device with the workpiece spindles 53 is preferably rotatable so that the workpiece spindles 53 can be moved from the rough processing area 51 to the fine processing area 52 and vice versa.

Preferably, the workpiece spindles or one-piece spindle housings 53 are arranged at a fixed distance from each other.

For changing the workpiece spindles 53 between the rough processing area 51 and the fine processing area 52, the spindle device with the workpiece spindles or the one-piece spindle housings 53 can preferably be rotated about an in particular vertical axis of rotation and/or by means of the rotating device 54, in particular by 180°.

Each workpiece spindle or one-piece spindle housing 53 preferably has a workpiece spindle, in particular in the form of two half spindles, namely an upper half spindle 55 and a lower half spindle 56. In the exemplary embodiment, both half spindles 55, 56 are designed to be drivable in the same direction of rotation in a manner known per se by means of an electric motor via a synchronous shaft with two belts (not shown) operatively connected to the synchronous shaft. However, the two half spindles 55, 56 can, for example, also be driven in the same direction of rotation by means of associated electric motors (not shown) in each case.

This defines a vertical axis of rotation C. Preferably, the lower half spindle 56, in contrast to the upper half spindle 55, is designed to be vertically displaceable in the direction of the axis z, so that a lens 16*a* to be processed can be held between the upper half spindle 55 and the lower half spindle 56 in a clamping manner on its two surfaces (not shown). In this case, in each case an adhesive force transmitted by the upper half spindle 55 and the lower half spindle 56 acts on both surfaces of the lens 16*a* to be machined.

In the embodiment, each half spindle 55, 56 further comprises an adhesive element (not shown) such that the surfaces of the lens 16*a* to be processed are clamped between the adhesive elements.

The adhesive elements are preferably made of an elastic plastic material that adapts to the respective surface contours of the lens 16*a*. Here, it is advantageous if the half spindles 55, 56, as provided in the exemplary embodiment, are designed to be rotatable in the same direction about the axis of rotation C and can be driven separately. In this way, the torques transmitted by the electric motor(s) are added, so that a particularly safe entrainment of the lens 16*a* to be processed is achieved during edge processing.

In the exemplary embodiment, the rough processing area 51 further preferably has exactly one tool spindle or tool spindle device 57 for receiving exactly one tool 58 for chip-removing edge machining of the lens 16*a* to be processed in each case, in particular held by the associated half spindles 55, 56.

In the exemplary embodiment, the tool spindle device 57 is held on an x-carriage 59*a* and/or a z-carriage 59*b* in such a way that it can be moved along a vertical z-axis and/or a horizontal x-axis. This allows the tool 58 to be advanced toward the lens 16*a* to be processed in the x-direction and/or in the z-direction.

Thus, in the exemplary embodiment, the tool spindle device 57 preferably does not have a swivel axis. Of course, further movement axes, including swivel axes, can be provided for feeding the tool 58.

In the exemplary embodiment, the tool 58 may be designed with comparatively small length dimensions in order to minimize processing errors, for example due to natural vibrations or bending of the tool 58, as well as the risk of damage to the tool 58.

A measuring device 60 with measuring probes 61 known per se is preferably also provided in the rough processing area 51. The measuring device 60 is preferably held together with the tool spindle device 57 on the x-carriage 59*a* and/or on the z-carriage 59*b* in such a way that it can also be moved in the x-direction and/or in the z-direction, as described above for the tool spindle device, so that the feed of the measuring probe 61 to the lens 16*a* can take place accordingly.

The measuring device 60 serves for measuring the approximately edge-machined lens 16*a* prior to transfer to the fine processing area 52 of the processing device 50.

In particular, the position in space of the upper and lower surfaces of the edge region of the approximately edge-processed lens 16*a* remaining after rough processing is determined.

Here, the probes 61 move on the surfaces between the obtained contour of the approximately edge-processed lens 16*a* and the calculated contour of the desired finished processed lens 16*b*. On this basis, the concrete production data for the fine processing of the approximately edge-machined lens 16*a* can be determined.

Subsequently, their transfer to the fine processing area 52 and the final fine processing to the finished processed lens 16*b* takes place. In this way, the most accurate fine processing to the finish-processed lens 16*b* is made possible.

The fine processing area 52 preferably has several, in the exemplary embodiment five, preferably different tools 62 for chip-removing machining of a lens 16*a* to be processed.

Each tool 62 is firmly mounted on a tool spindle 63 and is preferably provided for a single defined processing task. However, combination tools can also be present, which can be provided for two or more processing tasks.

The tools 62 are preferably selected in such a way that all lens edge types (in particular for spectacles with full frames, half frames and/or for rimless spectacles) can be produced. In particular, different tools 62 are provided for different processing tasks.

The tool spindles 63 are accommodated in a holding device 64 in any order. Preferably, the tool spindles 63 are accommodated in such a way that they can be easily exchanged and/or accommodated so as to be changed in their sequence.

The holding device 64 is preferably accommodated in an x-carriage 65*a* so as to be pivotable about a horizontally extending axis, thus defining a pivot axis B. The x-carriage 65*a* is in turn designed to be movable along an x-axis. The x-carriage 65*a* is preferably in turn held on a y-carriage 65*b*, which is designed to be movable along a y-axis extending at right angles to the x-axis.

Finally, the y-carriage 65*b* is preferably held on a z-carriage 66 which is designed to be movable along a z-axis perpendicular to the plane formed by the x-axis and the y-axis.

As a result, the tool spindles 63 with their tools 62 are preferably movable in all three spatial directions x, y, z and additionally about the pivot axis B and thus designed to be feedable to the respective lens 16*a* to be processed, which is held by the associated half spindles 55, 56.

The tools 62 can be selected independently of one another for fine processing of the lens 16*a* to be processed and individually fed to the lens 16*a* held in the associated one-piece spindle housing 53, which has already been roughly machined, by means of a linear movement in the y-direction and then brought into engagement with the lens 16*a* by means of a pivoting movement about the pivot axis B. This enables complete edge processing of the lens 16*a* to be processed, producing finished edge-processed lenses 16*b* of all sizes and/or with a wide variety of edge shapes.

This structure according to the invention permits an edge processing of the lens 16*a* with different tools 62, wherein, according to the invention, there is preferably no time-consuming tool change, but the tool 62 required in each case is fed to the lens 16*a* to be processed by means of a linear displacement and a subsequent pivoting movement of the holding device 64.

Since the tool spindles 63 and thus the tools 62 are advantageously arranged in the greatest possible spatial proximity to one another (i.e., without the tools 62 interfering with one another in their respective feed to the lens 16*a* to be processed), the feed paths for the tools 62 are very short, so that the feed movements themselves can also be performed very quickly.

To save further time, the tools 62 can be activated, i.e., set in rotational motion, already before the previous edge processing step is completed, i.e., before they are advanced to the lens 16*a* to be processed.

In the exemplary embodiment, the apparatus 1, 1', 1", 1''', 1'''' according to the invention has an integrated control system, specifically for all controllable components of the apparatus 1, 1', 1", 1''', 1'''' according to the invention, in particular for the buffer system 17, the handling device or apparatus 20, the at least one conveying device 30, the at least one measuring device 40 and/or the at least one processing device 50.

An exemplary embodiment of the method according to the invention can be carried out with the exemplary apparatus according to the invention just described, and preferably has the following method steps.

Preferably, transport boxes 13 are transported into the area of the apparatus 1, 1', 1", 1''', 1'''' according to the invention by means of the conveyor belt 12.

Each transport box 13 contains at least one, expediently two, lenses 16*a*, 16*b* to be processed which are assigned to it, preferably wherein each transport box is provided, for example, with identification data or with the production data and/or frame data 13*a* of the lenses to be processed which are assigned to it.

In principle, however, the lenses 16*a*, 16*b* and/or transport boxes 13 can also be transported to the apparatus 1, 1', 1", 1''', 1'''' and away from the apparatus 1, 1', 1", 1''', 1'''' in other ways.

In the area of the buffer belt 17*a*, the transport boxes 13 are preferably pushed one after the other from the conveyor belt onto the buffer belt 17*a* by means of the pusher 12*a*.

Subsequently, each transport box 13 preferably first passes a reading device 19 which reads out the identification data or the production data and/or frame data 19 and passes them on to the control system of the apparatus 1, 1', 1", 1''', 1''''.

The further transport of each transport box 13 on the buffer belt 17*a* into the measuring area 10*a* of the apparatus 1, 1', 1", 1''', 1'''' according to the invention is preferably controlled by stop devices 18 which, in a manner known per se, permit the further transport of each transport box 13 section-by-section depending on the control of the apparatus 1, 1', 1", 1''', 1''''.

When a transport box 13 has reached the end of buffer belt 17*a*, it can be pushed onto buffer belt 17*b* extending parallel to buffer belt 17*a*, for example in a manner known per se by means of a pusher.

The further transport of each transport box 13 on the buffer belt 17*b* out of the measuring area 10*a* of the apparatus 1, 1', 1", 1''', 1'''' according to the invention is preferably controlled by stop devices 18, which are provided with a locking device in a manner known per se and allow the further transport of each transport box 13 section-by-section depending on the control of the apparatus 1, 1', 1", 1''', 1''''.

During this section-by-section transport of the transport boxes 13, the lenses 16*a* to be processed which are assigned to them are removed from the transport boxes 13, in particular by means of the handling device or apparatus 20, and are fed to the further processes within the apparatus 1, 1', 1", 1''', 1'''' according to the invention.

The finished edge-processed lenses 16*b* are returned to the transport boxes 13 assigned to them and deposited therein, in particular by means of the handling device or apparatus 20.

At the latest when a transport box 13 has reached the end of the buffer belt 17*b* in the area of the conveyor belt 12, it is loaded with the finished edge-processed lenses 16*b* assigned to it and is pushed back onto the conveyor belt 12 and/or transported out of the area of the apparatus 1, 1', 1", 1''', 1'''' according to the invention by means of the following transport boxes 13.

Here, it is preferably not necessary for the lenses 16*a* to be processed to be removed in the order of the transport boxes 13 arriving on the buffer belt 17*a*.

The control system of the apparatus 1, 1', 1", 1''', 1'''' according to the invention preferably calculates the sequence of removal of the lenses 16*a* to be processed from their transport boxes 13 rather in such a way that the lenses 16*a* to be processed are removed from their respective transport boxes 13 depending on the utilization of the at least one measuring device 40 and/or the at least one processing device 50. This means that the lenses 16*a* to be processed can be measured or aligned and edge-processed at an optimum speed, in particular without waiting times, for example caused by a leading lens 16*a* with a long measuring and/or processing time.

Both the lenses 16*a* to be machined and the finished edge-processed lenses 16*b* can therefore preferably be removed from their transport boxes 13 or deposited in their transport boxes irrespective of the position of the transport boxes 13 assigned to them on the buffer belts 17*a*, 17*b*. At the latest when a transport box 13 has reached the end of the buffer belt 17*b* in the area of the conveyor belt 12, it must again be loaded with the finished edge-processed lenses 16*b* assigned to it.

As described above, by means of a third conveyor belt (not shown), an additional circulation of the transport boxes can be made possible to optimize the buffering effect of the buffer belts 17*a*, 17*b*.

After a lens 16*a* to be processed has been removed from its transport box 13, it is transported by the handling unit 20*a* to the measuring system 40 or the respective measuring device 40 which is available at that time. The lens 16*a* is deposited on a deposit table assigned to the respective lens holder 41 with its convex surface facing upwards, so that the lens 16*a* can be fixed in a manner known per se by the clamping devices of the lens holder 41 and transferred to the measuring device 40, as described for example in WO 2016/095939 A1.

The lens 16*a* to be machined is measured in a manner known per se.

Subsequently, the measured lens 16*a* is preferably picked up at its convex surface at the calculated block point by the handling unit 20*b* and released from the clamping devices of the lens holder 41.

The lens 16*a* to be processed is then aligned in a manner known per se, for example as described in WO 2016/095939 A1.

The control system now preferably decides to which conveying device 30*a*, 30*b* the measured and preferably aligned lens 16*a* is transferred, in particular while maintaining its alignment. This is preferably dependent on which processing device 50 assigned to the respective conveying device 30*a*, 30*b* can be newly loaded at this time.

Accordingly, the aligned lens 16*a*, while maintaining its orientation, is transferred from the handling unit 20*b* to the suction cup/gripper 34*a* of the selected conveying device, which now grips it preferably at its concave surface.

Preferably, but not necessarily simultaneously, the handling unit 20*a* picks up from the suction cup/gripper 35*a* of the selected conveying device 30*a*, 30*b* a finished processed lens 16*b* held by the latter on its concave surface, removes it from the suction cup/gripper 35*a* and deposits it in the transport box 13 assigned to it.

Now the carriage 33 of the selected conveying device 30*a*, 30*b* moves along the guide rail 32*a*, 32*b* out of the measuring area 10*a* of the apparatus 1, 1', 1", 1''', 1'''', 1'''' according to the invention into its processing area 10*b* and thereby preferably passes the partition wall 11 through the opening 11*a*, 11*b*. In this process, the door associated with the respective opening 11*a*, 11*b* preferably opens so that the carriage 33 can pass through the opening 11*a*, 11*b*.

The opening 11*a*, 11*b* is then preferably closed again by the door assigned to it.

When the carriage 33 is at the height of the processing device 50 in the rough processing area 51, a finished processed lens 16*b* is preferably transferred from a workpiece spindle or a one-piece spindle housing 53 to the conveying device 30*a*, 30*b*.

In particular, the suction cup/gripper 35*a* moves under the upper half spindle 55 of the workpiece spindle or the one-piece spindle housing 53 for this purpose and takes over the finished processed lens 16*b* held on the upper half spindle 55 at its concave surface. Then the pivotable holder 35 folds away in the direction of rotation D so that the suction cup/gripper 34*a* can move under the upper half spindle 35 of the workpiece spindle or the one-piece spindle housing 53. The lens 16*a* to be processed is picked up by the upper half spindle 55 while retaining its alignment and then released from the suction pad/gripper 34*a*.

Now the carriage 33 moves away and transports the finished processed lens 16*b* back into the measuring area 10*a* of the apparatus 1, 1', 1", 1''', 1'''' according to the invention, preferably again passing through the opening 11*a*, 11*b* in the partition wall 11 as described above.

The lower half spindle 56 of the one-piece spindle housing 53 moves up so that the lens 16*a* to be processed is fixed in its predetermined orientation and edge processing can begin.

Preferably simultaneously during these operations, another lens 16*a* is held in the spindle housing 53 located in the fine processing area 52 of the edge processing device 50 and finished processed. In this process, the tool spindles 63 can already move upwards before the lens 16*a* is transferred to the fine processing area 52 in order to keep the processing time as short as possible. Fine processing of the lens 16*a* to be processed usually takes longer than its rough processing.

Expediently, the number and/or the design and/or the sequence of the tools 62 are selected in such a way that the edge processing of the lenses 16*a* to be processed can be performed in the most time-saving manner possible. Since the tools 62 have feed paths of different lengths along the y-axis, a corresponding sequence or arrangement in the holder 64 can result in an overall minimum travel path of the holder 64, which in turn can shorten the processing time.

In the starting position of the carriage 33 in the measuring area 10*a* of the apparatus 1, 1', 1", 1''', 1'''' according to the invention, the handling unit 20*a* grips from the suction cup/gripper 35*a* the finished processed lens 16*b* held by the latter on the concave side, removes it from the suction cup/gripper 35*a* and deposits it in the transport box 13 assigned to it. Immediately afterwards, another measured and aligned lens 16*a* to be processed is transferred to the suction cup/gripper 34*a*, which now grips it on the concave side, while retaining its alignment.

This further lens 16*a* is now transferred to the processing area 10*b* of the apparatus 1, 1', 1", 1''', 1'''' according to the invention as described above.

In the meantime, edge-processing of the lens 16*b*, which has in the meantime been located in the fine processing area 52 of the processing device 50, has been finished.

By rotating the one-piece spindle housing 53, the finished processed lens 16*b* is transferred to the rough processing area 51 of the processing device 50, and the lens 16*a*, finished pre-processed as described above, is transferred to the fine processing area 52.

While the fine processing of the lens 16*a* begins, the finished processed lens 16*b* is waiting to be picked up by the carriage 33 as described above. The cycle described begins again.

Thus, all measuring devices 40, 110 can be equipped in any order with lenses 160 to be measured or lenses 16*a* to be processed.

Likewise, each conveying device 30*a*, 30*b* can be loaded in any order with a measured and aligned lens 16*a* to be processed.

On the basis of the production data and/or frame data of the lenses 16*a* to be processed, which may have been read out by the reading device 19 and transmitted to the control system of the apparatus 1, 1', 1", 1''', 1'''' or stored there, the control system thus preferably calculates both the sequence in which the lenses 16*a* are processed and the selection of the respective measuring device 40, 110 and the respective conveying device 30*a*, 30*b* and the respective processing device 50 for each individual lens 16*a* to be processed. This calculation is carried out in particular in such a way that an optimum time sequence of the measuring, the conveying and the edge processing of the respective lens to be processed is realized, in particular with as little waiting time as possible.

A control system or monitoring device suitable for the method according to the invention is in particular capable of managing processing statuses for the lenses 16*a* to be processed.

The required measuring and processing steps for each lens 16*a* are preferably defined in a so-called processing plan.

If several measuring devices 40, 110 and/or several processing devices 50 are provided, the specific measuring device 40, 110 and/or processing device 50 to be used is preferably freely selected for each lens 16*a*, i.e. independently of any other measuring device 40, 110 and/or processing device 50 present.

In doing so, the basic sequence "measurement—rough processing—fine processing" remains unchanged for each lens 16*a*.

The actual processing condition of each lens 16*a* is reflected in the processing status. The processing status indicates, for example, which measurement or processing has already been carried out or is to be carried out next, wherein this is particularly preferably carried out with reference to the corresponding processing plan for each lens 16*a*.

A control system or monitoring device suitable for the method according to the invention is also preferably suitable for managing, for each lens 16*a*, its individual measuring time in a measuring device 40, 110 and individual processing time in a processing device 50 and/or for determining the occupancy time for each measuring device 40, 110 and processing device 50, i.e. that period of time during which the respective measuring device 40, 110 and the respective processing device 50 is blocked by the lens 16*a* concerned.

Based on this, the control system or monitoring device can determine the sequence of measurement and processing of the lenses 16*a*. On the one hand, the determination is preferably made in such a way that the measuring device(s) 40, 110 and the processing device(s) 50 can be operated as far as possible without dead times. On the other hand, the determination is particularly preferably carried out in such a way that the sequence of the measurement and processing of the lenses 16*a* is determined independently of the sequence in which their respective transport boxes are arranged on the buffer belts 17*a*, 17*b*.

In particular, with such a control system or monitoring device, in accordance with the above-described exemplary embodiment of the method according to the invention, the handling device or apparatus 20 and the conveying devices 30*a*, 30*b* can be operated in such a way that the two measuring devices 40, 110 are, independently of each other, controlled, loaded with a lens to be measured and unloaded from a measured lens.

In a comparable manner, the two processing devices 50 can be, independently of each other, controlled, loaded with a lens 16*a* to be processed or unloaded from a lens 16*b* that has already been edge processed.

The measurement and edge processing of lenses 16*a* to be processed can thus be carried out according to the invention in such a way that lenses 16*a* to be processed in a simple and complex manner can be optimally distributed to the measuring devices 40 and processing devices 50, respectively, so that they can be measured and edge processed, respectively, with the least possible expenditure of time or loss of time.

For this purpose, the control system of the device according to the invention has the respective production or frame data of the lenses 16*a* to be processed availabe. The handling device or apparatus 20 and/or the conveying devices 30*a*, 30*b* can thus be controlled in such a way that the lenses 16*a* to be processed are optimally distributed to free measuring devices 40 and/or conveying devices 30*a*, 30*b* and/or processing devices 50 in order to achieve the most time-saving measurement and/or edge processing possible.

The lens data required for this purpose, e.g. processing data, processing plans, processing sequences, processing steps, optical data and/or geometric data, are either stored in the control system or monitoring device by means of a storage medium and/or are read out from the data carriers 13*a* as described above when the respective transport box 13 enters the machine.

The registering of the respective processing statuses of the individual lenses 16*a*, 16*b* located in the device according to the invention thus serves to control, coordinate and organize the sequence of the individual measuring and processing processes in the respective measuring device(s) 40, 110 and processing device(s) 50.

These processing statuses can alternatively or additionally be transmitted to an external monitoring system or control center, stored by it and/or displayed to an operator. Thus, for example, for each individual lens 16*a*, 16*b* it can be registered and stored in which measuring device 40, 110 it was measured and in which processing device 50 it was processed. Such data acquisition can be useful in particular for troubleshooting and/or error correction if a finished lens 16*b* does not correspond to the production and/or frame data assigned to it.

In a comparable manner, however, the respective operating states of the buffer area 17, the handling device(s) or apparatus(es) 20, the measuring device(s) 40, 110, the conveying device(s) 30*a*, 30*b* and/or the processing device(s) 50 can also be transmitted to such a monitoring system, stored by it and/or displayed to an operator. Depending on the requirements of the individual case, "on", "off", "ready for operation", "waiting for lens", "processing lens", "lens ready for delivery", "number of movements", "number of lenses measured", "number of lenses processed", "downtime", "maintenance required", "tool change required", "malfunction", etc. can be defined as operating states. In this way, in particular, the condition, utilization and efficient operation of the apparatus according to the invention can be checked particularly easily and, if necessary, appropriate measures such as tool change, repair, optimization of the time sequences, etc. can be taken.

The following Tables 1 and 2 show, in conjunction with FIG. 15, an exemplary time schedule for the process according to the invention in an apparatus according to the invention as a whole (Table 1) and for each process individually (Table 2). The times are given in seconds in each case.

In particular, FIG. 15 represents a graphical representation or reproduction of the operations 1*a*-6*g* listed in Table 1. By way of example, FIG. 15 shows simultaneous processing in two stations, the stations designated "Station 1" and "Station 2" in FIG. 15 corresponding to two processing devices 50, in particular of identical construction.

TABLE 1

| | Process | Start | Time | End |
|---|---|---|---|---|
| 1a | Transfer buffer area 17 → measuring device 40, 110 | 0 | 5 | 5.0 |
| 2a | A measuring device 40, 110 | 4 | 24.0 | 28.0 |
| 3a | Transfer measuring device 40, 110 → conveying device 30a, 30b | 27 | 5.0 | 32.0 |
| 4a | A conveying device 30a, 30b | 31 | 7.0 | 38.0 |
| 5a | A processing device 50 | 35 | 37.0 | 72.0 |
| 6a | Transfer conveyor 30a, 30b → buffer area 17 | 37 | 5.0 | 42.0 |
| 1b | Transfer buffer area 17 → measuring device 40, 110 | 10.0 | 5.0 | 15.0 |
| 2b | A measuring device 40, 110 | 14 | 24.0 | 38.0 |
| 3b | Transfer measuring device 40, 110 → conveying device 30a, 30b | 37 | 5.0 | 42.0 |
| 4b | A conveying device 30a, 30b | 41 | 7.0 | 48.0 |
| 5b | A processing device 50 | 44 | 37.0 | 81.0 |
| 6b | Transfer conveying device 30a, 30b → buffer area 17 | 47 | 5.0 | 52.0 |
| 1c | Transfer buffer area 17 → measuring device 40, 110 | 18 | 5 | 23.0 |
| 2c | A measuring device 40, 110 | 28 | 24.0 | 52.0 |
| 3c | Transfer measuring device 40, 110 → conveying device 30a, 30b | 51 | 5.0 | 56.0 |
| 4c | A conveying device 30a, 30b | 56 | 19.0 | 75.0 |
| 5c | A processing device 50 | 71 | 37.0 | 108.0 |
| 6c | Transfer conveying device 30a, 30b → buffer area 17 | 74 | 5.0 | 79.0 |
| 1d | Transfer buffer area 17 → measuring device 40, 110 | 26 | 5.0 | 31.0 |
| 2d | A measuring device 40, 110 | 38 | 24.0 | 62.0 |
| 3d | Transfer measuring device 40, 110 → conveying device 30a, 30b | 61 | 5.0 | 66.0 |
| 4d | A conveying device 30a, 30b | 65 | 19.0 | 84.0 |
| 5d | A processing device 50 | 80 | 37.0 | 117.0 |
| 6d | Transfer conveyor 30a, 30b → buffer area 17 | 83 | 5.0 | 88.0 |
| 1e | Transfer buffer area 17 → measuring device 40, 110 | 33 | 5 | 38.0 |
| 2e | A measuring device 40, 110 | 52 | 24.0 | 76.0 |
| 3e | Transfer measuring device 40, 110 → conveying device 30a, 30b | 75 | 5.0 | 80.0 |
| 4e | A conveying device 30a, 30b | 79 | 32.0 | 111.0 |
| 5e | A processing device 50 | 107 | 37.0 | 144.0 |
| 6e | Transfer conveying device 30a, 30b → buffer area 17 | 110 | 5.0 | 115.0 |
| 1f | Transfer buffer area 17 → measuring device 40, 110 | 43 | 5.0 | 48.0 |
| 2f | A measuring device 40, 110 | 62 | 24.0 | 86.0 |
| 3f | Transfer measuring device 40, 110 → conveying device 30a, 30b | 85 | 5.0 | 90.0 |
| 4f | A conveying device 30a, 30b | 89 | 31.0 | 120.0 |
| 5f | A processing device 50 | 116 | 37.0 | 153.0 |
| 6f | Transfer conveyor 30a, 30b → buffer area 17 | 119 | 5.0 | 124.0 |
| 1g | Transfer buffer area 17 → measuring device 40, 110 | 59 | 5 | 64.0 |
| 2g | A measuring device 40, 110 | 76 | 24.0 | 100.0 |
| 3g | Transfer measuring device 40, 110 → conveying device 30a, 30b | 99 | 5.0 | 104.0 |
| 4g | A conveying device 30a, 30b | 103 | 44.0 | 147.0 |
| 5g | A processing device 50 | 143 | 37.0 | 180.0 |
| 6g | Transfer conveying device 30a, 30b → buffer area 17 | 146 | 5.0 | 151.0 |

Here, a respective duration of 1 second was assumed for each handover.

TABLE 2

| Process | Time [s] |
|---|---|
| 1 Transfer buffer area 17 → measuring device 40, 110 | Σ 5 |
| Gripping/sucking a lens 16a | 1 |
| Lifting the lens 16a (Z-stroke) | 1 |
| Transport to a measuring device 40, 110 | 2 |
| Depositing the lens 16a in the measuring device 40, 110 | 1 |
| 2 One measuring device 40, 110 | Σ 24 |
| | 12 |
| | 12 |
| 3 Transfer of measuring device 40, 110 → Conveying device 30a, 30b | Σ 5 |
| Gripping/sucking the measured lens 16a | 1 |
| Lifting the measured lens 16a (Z-stroke) | 2 |
| Transport to a conveying device 30a, 30b | 1 |
| Placing the lens 16 on the gripper/suction cup 34a | 1 |
| 4 A conveying device 30a, 30b | Σ 7 |
| Taking the measured lens 16a | 1 |
| Transport of the measured lens 16a to the processing device 50 | 1 |
| Picking up a finished processed lens 16b on gripper/suction cup 35a | 1 |

TABLE 2-continued

| Process | Time [s] |
|---|---|
| Swiveling away the gripper/suction cup 35a | 0.5 |
| Moving the measured lens 16a into the rough processing area 51 | 0.5 |
| Transfer of the measured lens 16a | 1 |
| Transport of the finished processed lens 16b into the measuring area 10a | 1 |
| Transfer of the finished processed lens 16b to the handling apparatus 20a | 1 |
| 5 A processing device | Σ 37 |
| Taking of the lens 16a | 1 |
| V-Bevel | 22 |
| Safety Bevel | 12 |
| Rotate | 1 |
| Transfer of the finished processed lens 16b to gripper/suction cup 35a | 1 |
| 6 Transfer conveying device 30a, 30b → buffer area 17 | Σ 5 |
| Gripping/sucking of the finished lens 16b | 1 |
| Lifting the finished processed lens 16b (Z-stroke) | 1 |
| Transporting the finished processed lens to the buffer area 17 | 1 |
| Lowering the finished processed lens 16b (Z-stroke) | 1 |
| Depositing the finished processed lens 16b in the assigned transport box 13 | 1 |

Thus, the apparatus 1, 1', 1", 1''', 1'''' according to the invention and/or the method according to the invention preferably allow edge processing of lenses with a throughput of at least 100 lenses per hour. In particular, in combination with the processing device 50 according to the invention, a throughput of up to 250 lenses per hour can be achieved.

Accordingly, the present invention is advantageously characterized by one or more of the following features in any combination:

at least one transport box, at least one reading device, at least one measuring device, at least one conveying device and/or at least one processing device are provided;

the at least one measuring device, the at least one conveying device and the at least one processing device are arranged or arrangeable in any orientation to each other;

each processing device is linked to at least one conveying device;

each conveying device, the measuring device and/or the at least one transport box are linked via a handling device or apparatus;

a handling device or apparatus is provided for transferring the lenses from at least one transport box into the at least one measuring device, from the at least one measuring device to the at least one transfer device and/or from the at least one transfer device into the at least one transport box;

at least two measuring devices and at least two processing devices are provided, which are linked to each other by at least two conveying devices;

identically constructed measuring devices and/or identically constructed processing devices are provided;

the at least one measuring device is suitable or designed for non-contact measurement by means of deflectometry, transmission radiation and/or luminescence radiation;

the at least one processing device is suitable or designed for processing two lenses at the same time;

the at least one processing device has a rough processing area and a fine processing area;

the rough processing area serves as a loading and unloading area;

the at least one processing device has two workpiece spindles or spindle housings that can be rotated through 180° and/or are arranged offset from one another;

the rotation of the workpiece spindles or spindle housings allows a change of the processing method for the lens to be processed;

each spindle housing is designed in one piece and is therefore particularly stable against the forces acting during lens processing;

the spindle accommodated in the one-piece spindle housing is designed in two parts;

the upper half spindle is designed to be rotatable and stationary, the lower half spindle of the one-piece spindle housing is designed to be rotatable in the same direction as the upper half spindle and movable in the z-direction (vertically);

a tool in the rough processing area is designed to be feedable in the z-direction and in the x-direction to the lens to be processed, i.e. it moves toward and away from the lens as well as in the vertical direction for depth adjustment;

several tools in the fine processing area are arranged in parallel and/or can be fed individually or brought into engagement with the lens to be processed (in particular by linear movement(s) and/or swiveling movement(s)) and/or can be replaced individually and/or are designed for different processing tasks and/or can be arranged in any sequence;

adhesive elements on the spindle parts are dimensioned (e.g. 20 mm by 10 mm in elliptical shape) so that lenses of all sizes (even for children) can be held securely;

the at least one transport box is provided in a transport box feed and/or discharge area;

the feed and/or discharge area is designed as a buffer area;

the buffer area has a third conveyor belt for circulating the transport boxes;

the apparatus has a measuring area and a processing area;

the measuring area has the feed and/or discharge area and the at least one measuring device;

the processing area has the at least one processing device;

the at least one conveying device extends over the measuring area and the processing area;

the measuring area and the processing area are separated from each other by a partition wall, with the at least one conveying device passing through at least one opening provided in the partition wall;

the at least one opening is provided with a door which can be opened for the passage of at least one transported lens and can be closed again after the passage of the at least one transported lens;

any number of measuring devices and/or conveying devices and/or processing devices can be combined with each other;

the measuring and processing of the lenses are designed to be decoupled from each other;

neither measuring nor processing must be synchronous with each other or crosswise;

the design and mode of operation of the measuring equipment and/or the conveying equipment and/or the processing equipment are freely selectable;

measuring devices and/or conveying devices and/or processing devices can be selected depending on measuring and/or processing effort and/or free capacities at measuring devices and/or processing devices;

a higher-level control system/status management (Control Center) controls the selection of the measuring device(s) and processing device(s) for optimum, time-saving distribution of the lenses to be processed to a free measuring device and/or processing device lenses entering the apparatus later can be measured and processed earlier than lenses received in the apparatus before; these can remain in the buffer area until a measuring device or processing device is selected for them by the control system;

the measuring device(s) and processing device(s) are decoupled, i.e. there is no fixed assignment of a measuring device to exactly one processing device.

LIST OF REFERENCE SIGNS

1', 1", 1''', 1'''' Apparatus
10 10'''' housing
10*a* Measuring area
10*b* Processing area
11 Partition wall between 10*a* and 10*b*
11*a*, 11*b* Openings in 11
12 external conveyor belt (transport boxes)
12*a* Pusher at 12
13 Transport boxes (lenses)
13*a* Data carrier at 13 with production data and/or frame data

14 Swivel arm
14*a* Operating unit
15 Switch cabinet
16*a* Lenses to be processed
16*b* edge-processed lenses
17 Buffer area
17*a* Buffer belt, incoming
17*b* Buffer belt, running out
18 Stop devices
19 Reading device
20 Handling device or apparatus in 10*a*
20*a* first handling unit of 20
21 first rail of 20*a*
21*a*, 21*b* Guides of 20*a*
22 second rail of 20*a*
23 Gripping apparatus of 20*a*
24 Gripper or suction cup of 20*a*
20*b* second handling unit of 20
25 first rail of 20*b*
26 second rail of 20*b*
27 Gripping device of 20*b*
28 Gripper or suction cup of 20*b*
29*a, b, c, d* E-motors
30*a*, 30*b* Conveying device
31*a*, 31*b* Linear feeder
32*a*, 32*b* Guide rail
33 Carriage
34 rigid holder
34*a* Gripper or suction cup
35 pivotable holder
35*a* Gripper or suction cup
36
37
38
39
40 Measuring device
41 Lens holder
41*a* Frame of 41
42 Measuring table
43
44
45
46
47
48
49
50 Processing device
51 Rough processing area
52 Fine processing area
53 Workpiece spindle/One-piece spindle housing
54 Rotating device of 53
55 Half spindle top
56 Half spindle bottom
57 Tool spindle device of 51
58 Tool of 57
59 Support frame
59*a* x-carriage
59*b* z-carriage
60 Measuring device
61 Measuring probe of 60
62 Tools in 52
63 Tool spindles for 62
64 Holding device for 63
65*a* x-carriage
65*b* y-carriage
66 z-Carriage
67 Housing
68 Trough
69 Aspiration opening
Arrow E Entrance transport boxes
Arrow R Return transport transport boxes
Arrow L
Arrow M Directions of movement of 20*a*
Arrow N
Arrow O
Arrow P Directions of movement of 20*b*
Arrow Q
Arrow S Conveying direction of 30*a*
Arrow T Conveying direction of 30*b*
Direction of rotation D of 34*a*, 35*a*
Direction of rotation Tr of 53
110 Measuring device
111 Holding table
112 Bottom side of 111
113 Top side of 111
114 Recess
115 Holding element
116 Drive unit
117 Rack
118 Engine
119
120 Measuring/detection device
121 Holder of 120
122 Camera
123 Camera objective
124 Engine
125 Opening in 121
126
127
128
129
130 Gripping unit
131 Holding plate
132 Guide plate
133*a* Guide shoe
133*b* Guide rail
134 Gripping device
135 Gripping elements
136 pneum. cylinder drive f. 135
137 Deposit table
138 Holding arm of 137
139 Bearing and swiveling apparatus f. 138
139' Drive cylinder for 139
140 first radiation source
140*a,b* Groups of 140
140' further radiation source
141 Laser diodes
142 Lines
143' Mask
144 Gripping and centering arrangement
145 Pair of gripping devices 134
146 Turning device
147 Adjustment device
148
149
150 second radiation source
151 Receiving plate
152
153
154
155
156
157
158

159
160 Lens to be measured/processed
160' Coating of 160
161 Top side of 160
162 Bottom side of 160
163 Edge of 160
164
165
166
167
168
169
170 Evaluation device
201-210 Method steps
Z' Axis of motion (z-axis)
M' Measuring axis
S' Swivel axis
D' Rotation axis
B Pivot axis

The invention claimed is:

1. An apparatus configured for lens processing, comprising:

at least one buffer area configured to handle at least one transport box, at least one measuring device, at least one processing device, at least one conveying device, at least one handling device, and a common housing, the at least one measuring device, the at least one processing device, and the at least one conveying device located inside the common housing, the common housing having a partition wall, the partition wall located between and separating the at least one measuring device and the at least one processing device, wherein the common housing is subdivided by the partition wall into a measuring area and a processing area, wherein in the measuring area, the at least one measuring device is provided, and the at least one processing device is arranged in the processing area, wherein the at least one conveying device is provided between the at least one measuring device and the at least one processing device, and the at least one conveying device passes through the partition wall, wherein the at least one handling device is provided between the at least one buffer area, the at least one measuring device and the at least one conveying device in such a way that the at least one measuring device, the at least one conveying device and the at least one processing device are arranged or can be arranged in any number and/or orientation with respect to one another, and wherein the transfer of lenses to be processed from their transport boxes to a selectable measuring device, from the measuring device to a selectable conveying device, as well as the transfer of finished processed lenses from the respective conveying device back to their transport boxes is carried out via the at least one handling device.

2. The apparatus according to claim 1, wherein the handling device has at least one of i) a first handling unit configured to transfer the lenses from at least one transport box into the at least one measuring device and from the at least one conveying device into the at least one transport box, or ii) a second handling unit configured to transfer the lenses from the at least one measuring device to the at least one conveying device.

3. The apparatus according to claim 1, wherein at least one of:

i) the at least one buffer area is provided in the measuring area, and ii) the at least one conveying device extends over at least one of: a) at least one measuring area, and b) at least one processing area.

4. The apparatus according to claim 1, wherein at least one measuring area and at least one processing area are separated from each other by the partition wall.

5. The apparatus according to claim 4, wherein at least one conveying device passes through a respective opening in the partition wall.

6. The apparatus according to claim 5, wherein the openings are provided with doors which uncover the openings before a lens transported by a conveying device passes through and close them again after passage.

7. The apparatus according to claim 1, wherein the at least one conveying device is configured to transport the measured and aligned lenses to be processed from the measuring area into the processing area of the apparatus while maintaining their spatial orientation.

8. The apparatus according to claim 1, wherein the at least one conveying device is configured as a linear conveyor comprising a guide rail for guiding a carriage, the carriage being movably arranged on the guide rail.

9. The apparatus according to claim 8, wherein a rigid holder with a first gripper or suction cup and a holder pivotable about a pivot axis with a second gripper or suction cup are arranged on the carriage, in particular wherein the first gripper or suction cup serves to receive the measured lens and is configured in such a way that it can receive the lens, which has been measured and aligned for edge processing, in its respective alignment and that this alignment is maintained during transport of the lens to the processing device, while the second gripper or suction cup serves to receive the finished edge-processed lens.

10. The apparatus according to claim 1, wherein at least two processing devices are provided.

11. The apparatus according to claim 1, wherein at least two measuring devices are provided.

12. The apparatus according to claim 1, wherein identically constructed measuring devices and/or identically constructed processing devices are provided.

13. The apparatus according to claim 1, wherein at least one measuring device is configured for contactless measurement by deflectometry, transmission radiation and/or luminescence radiation.

14. The apparatus according to claim 1, wherein the at least one buffer area includes one or more of: buffer belts, roller conveyors and conveyor belts.

15. The apparatus according to claim 1, wherein the common housing accommodates the handling device.

16. The apparatus according to claim 1, wherein the measuring area is free of processing devices and wherein the processing area is free of measuring devices.

17. An apparatus configured to process lens comprising:

two measuring devices, two processing devices, two conveying devices, a handling device, and a common housing, the two measuring devices, the two processing devices, and the two conveying devices located inside the common housing, the common housing having a partition wall, the partition wall located between and separating the two measuring devices and the two processing devices, wherein the common housing is subdivided by the partition wall into a measuring area and a processing area, the two conveying devices passing through the partition wall, wherein the handling device is movable between the measuring devices and the conveying devices and includes a handling unit configured to transfer the lenses from the measuring devices to the conveying devices, so that there is no fixed assignment of a measuring device to exactly one processing device, and wherein the transfer of lenses to be processed from their transport boxes to a selectable measuring device, from the measuring device to a selectable conveying device, as well as the transfer of finished processed lenses from the respective conveying device back to their transport boxes, is carried out via the handling device.

18. An apparatus configured to process lenses comprising:

a first and a second measuring device configured to measure one or more of the lenses to be processed, a first and a second processing device configured to process one or more of the lenses, a handling device configured to selectively convey the lenses, after a measurement in one of the measuring devices, to the first or the second processing device, or to a conveying device assigned to a respective processing device, and a common housing, the first and second measuring device and the first and second processing device located within the common housing and separated by a partition wall, the conveying device passing through the partition wall.

19. The apparatus according to 18, wherein the handling device is configured to remove lenses from both measuring devices and to transfer the lenses selectively to one of the processing devices, or to a conveying device assigned to the respective processing device that is configured to convey the lenses to the respective processing device.

* * * * *